US010865790B2

(12) United States Patent
Joo et al.

(10) Patent No.: US 10,865,790 B2
(45) Date of Patent: Dec. 15, 2020

(54) SCROLL COMPRESSOR HAVING A CAPACITY VARIABLE DEVICE

(71) Applicant: LG ELECTRONICS INC., Seoul (KR)

(72) Inventors: Sangwoo Joo, Seoul (KR); Honggyun Jin, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 357 days.

(21) Appl. No.: 15/874,538

(22) Filed: Jan. 18, 2018

(65) Prior Publication Data

US 2018/0209422 A1 Jul. 26, 2018

(30) Foreign Application Priority Data

Jan. 26, 2017 (KR) ..... 10-2017-0013013

(51) Int. Cl.

| | |
|---|---|
| ***F04C 28/26*** | (2006.01) |
| ***F04C 18/02*** | (2006.01) |
| ***F04C 23/00*** | (2006.01) |
| ***F04C 28/24*** | (2006.01) |
| ***F04C 29/12*** | (2006.01) |

(52) U.S. Cl.

CPC ..... *F04C 28/26* (2013.01); *F04C 18/0215* (2013.01); *F04C 18/0261* (2013.01); *F04C 23/008* (2013.01); *F04C 28/24* (2013.01); *F04C 29/12* (2013.01); *F04C 2240/30* (2013.01); *F04C 2250/102* (2013.01)

(58) Field of Classification Search

CPC .. F04C 28/26; F04C 18/0215; F04C 18/0261; F04C 23/008; F04C 28/24; F04C 2240/30

USPC ..... 418/55.1–55.5, 57, 180, 270

See application file for complete search history.

(56) References Cited

U.S. PATENT DOCUMENTS

| | | | | |
|---|---|---|---|---|
| 5,336,058 | A | 8/1994 | Yokoyama | |
| 5,855,475 | A | 1/1999 | Fujio et al. | |
| 7,976,295 | B2 * | 7/2011 | Stover | F04C 28/265 417/299 |

(Continued)

FOREIGN PATENT DOCUMENTS

| | | | |
|---|---|---|---|
| CN | 1576601 | A | 2/2005 |
| CN | 101424265 | A | 5/2009 |

(Continued)

OTHER PUBLICATIONS

Office Action of Chinese Patent Office in Appl'n No. 201810076932.2, dated Jan. 21, 2020.

*Primary Examiner* — Deming Wan

(74) *Attorney, Agent, or Firm* — Dentons US LLP

(57) ABSTRACT

A scroll compressor formed having a casing, a compression unit provided in an inner space of the casing to form a compression chamber composed of an inner pocket and an outer pocket by a pair of two scrolls, and bypass holes provided in the compression unit to bypass refrigerant suctioned into the compression chamber to the inner space of the casing to vary compression capacity, wherein the bypass holes are formed in a compression chamber constituting the inner pocket and a compression chamber constituting an outer pocket to be located in compression chambers having different pressures along a movement path of the respective compression chambers.

4 Claims, 15 Drawing Sheets

(56) References Cited

U.S. PATENT DOCUMENTS

| | | | | |
|---|---|---|---|---|
| 7,976,296 | B2 * | 7/2011 | Stover | F04C 18/0215 417/299 |
| 2009/0110570 | A1 | 4/2009 | Cho | |
| 2009/0297379 | A1 * | 12/2009 | Stover | F04C 23/008 418/55.1 |

FOREIGN PATENT DOCUMENTS

| | | | |
|---|---|---|---|
| CN | 102089525 | A | 6/2011 |
| CN | 102149921 | A | 8/2011 |
| CN | 102449313 | A | 5/2012 |
| CN | 102449314 | A | 5/2012 |
| CN | 102588277 | A | 7/2012 |
| CN | 103573619 | A | 2/2014 |
| CN | 104196725 | A | 12/2014 |
| CN | 104314809 | A | 1/2015 |
| CN | 104838143 | A | 8/2015 |
| JP | 02-223690 | A | 9/1990 |
| KR | 10-2004-0091362 | A | 10/2004 |

* cited by examiner

SCROLL COMPRESSOR HAVING A CAPACITY VARIABLE DEVICE

CROSS-REFERENCE TO RELATED APPLICATIONS

The present disclosure relates to subject matter contained in priority Korean Application No. 10-2017-0013013, filed on Jan. 26, 2017, which is herein expressly incorporated by reference in its entirety.

BACKGROUND OF THE INVENTION

1. Field of the Invention

The present disclosure relates to a scroll compressor, and more particularly, to a scroll compressor provided with a capacity variable device.

2. Description of the Related Art

A scroll compressor is a compressor having a non-orbiting scroll and an orbiting scroll, in which the non-orbiting scroll is provided within an inner space of a casing to form a pair of compression chambers formed with a suction chamber, an intermediate pressure chamber, and a discharge chamber between a non-orbiting wrap of the non-orbiting scroll and an orbiting wrap of the orbiting scroll while the orbiting scroll is engaged with the non-orbiting scroll to perform an orbiting motion.

The scroll compressor is commonly used for compressing refrigerant in an air conditioner or the like because it obtains a relatively high compression ratio as compared with other types of compressors, and obtains a stable torque due to suction, compression, and discharge strokes of the refrigerant being more smoothly carried out.

The scroll compressor may be classified as either a high pressure type or a low pressure type depending on how refrigerant is supplied to the compression chamber. In the high pressure scroll compressor, refrigerant is suctioned directly into the suction chamber without passing through the inner space of the casing, and then discharged through the inner space of the casing. Most of the inner space of the high pressure scroll compressor forms a discharge space which is a high pressure portion. On the other hand, in the low pressure scroll compressor, refrigerant is indirectly suctioned into the suction chamber through the inner space of the casing. The inner space of the low pressure scroll compressor is divided into a suction space which is a low pressure portion and a discharge space which is a high pressure portion.

FIG. 1 is a longitudinal cross-sectional view illustrating a low pressure scroll compressor in the related art.

As illustrated in FIG. 1, the low pressure scroll compressor has a drive motor 20 for generating a rotational force in an inner space 11 of a closed casing 10, and a main frame 30, which are provided at an upper side of the drive motor 20.

On an upper surface of the main frame 30, an orbiting scroll 40 is orbitably supported by an oldham ring (not shown), and a non-orbiting scroll 50 is engaged with an upper side of the orbiting scroll 40, and provided to form a compression chamber (P). A rotation shaft 25 is coupled to a rotor 22 of the drive motor 20 and the orbiting scroll 40 is eccentrically engaged with the rotation shaft 25, and the non-orbiting scroll 50 is coupled to the main frame 30 in a rotationally constrained manner.

A back pressure chamber assembly 60 for preventing the non-orbiting scroll 50 being floated by a pressure of the compression chamber (P) during operation is coupled to an upper side of the non-orbiting scroll 50. The back pressure chamber assembly 60 is formed with a back pressure chamber 60*a* filled with refrigerant at an intermediate pressure.

A high-low pressure separation plate 15 for separating the inner space 11 of the casing 10 into a suction space 11 as a low pressure portion and a discharge space 12 as a high pressure portion while at the same time supporting a rear side of the back pressure chamber assembly 60 is provided at an upper side of the back pressure chamber assembly 60.

An outer circumferential surface of the high-low pressure separation plate 15 is coupled to an inner circumferential surface of the casing 10, and a discharge hole 15*a* communicating with a discharge port 54 of the non-orbiting scroll 50 is formed at a central portion thereof.

In FIG. 1, there is also a suction pipe 13, a discharge pipe 14, a subframe 18, a stator 21, a winding coil 21*a*, an end plate portion of an orbiting scroll 41, an orbiting wrap 42, an end plate portion of a non-orbiting scroll 50, a non-orbiting wrap 51, a suction port 53, and a modulation ring 61 for variable capacity, respectively.

According to the foregoing scroll compressor, when power is applied to the drive motor 20 to generate a rotational force, the rotation shaft 25 transmits the rotational force of the drive motor 20 to the orbiting scroll 40. Then, the orbiting scroll 40 forms a pair of two compression chambers (P) between the orbiting scroll 50 and the non-orbiting scroll 50 while performing an orbiting motion with respect to the non-orbiting scroll 50 by the oldham ring to suction, compress, and discharge refrigerant.

At this time, a portion of the refrigerant compressed in the compression chamber (P) moves from the intermediate pressure chamber to the back pressure chamber 60*a* through a back pressure hole (not shown), and refrigerant at the an intermediate pressure flowing into the back pressure chamber 60*a* generates a back pressure to float a floating plate 65 constituting the back pressure chamber assembly 60. The floating plate 65 is brought into close contact with a lower surface of the high-low pressure separation plate 15 to allow a back pressure chamber pressure to push the non-orbiting scroll 50 to the orbiting scroll 40 while at the same time separating the suction space 11 and the discharge space 12 from each other, thereby allowing the compression chamber (P) between the non-orbiting scroll 50 and the orbiting scroll 40 to maintain airtight seal.

Here, similar to other compressors, the scroll compressor may vary a compression capacity in accordance with the demand of an apparatus (such as a freezer) to which the compressor is applied. For example, as illustrated in FIG. 1, a modulation ring 61 and a lift ring 62 are provided at an end plate portion 51 of non-orbiting scroll 50, and a control valve 63 being communicated by the back pressure chamber 60*a* and a first communication path 61*a* is provided at one side of the modulation ring 61. Furthermore, a second communication path 61*b* is formed between the modulation ring 61 and the lift ring 62, and a third communication path 61*c* being open when the modulation ring 61 floats is formed between the modulation ring 61 and the non-orbiting scroll 50. One end of the third communication path 61*c* communicates with the intermediate pressure chamber (P) and the other end thereof communicates with the suction space 11 of the casing 10.

In such a scroll compressor, during a power operation, the control valve 63 closes the first communication path 61*a* and allows the second communication path 61*b* to communicate with the suction space 11, as illustrated in FIG. 2A, thereby keeping the third communication path 61*c* in a closed state.

On the other hand, during a power saving operation, as illustrated in FIG. 2B, the control valve 63 allows the first communication path 61*a* to communicate with the second communication path 61*b*, thereby reducing compressor capacity while a portion of refrigerant in the intermediate pressure chamber P leaks into the suction space 11 and the modulation ring 61 floats to open the third communication path 61*c*.

However, according to a capacity variable device of the scroll compressor in the related art, concerning load of a refrigeration cycle device, it may be advantageous, as the capacity variation ratio of the compressor is lowered, to form a bypass hole 51*a* for capacity variation at a position illustrated in FIG. 3A rather than at a position moved toward the discharge port illustrated in FIB. 3B so as to increase a variable capacity (67%→60%) between a total load operation (hereinafter, referred to as a power operation) and a partial load operation (hereinafter, referred to as a saving operation). However, in terms of the compressor, it is disadvantageous to move the bypass hole 51*a* toward the discharge port in order to lower the capacity variation ratio.

In other words, during the power operation, since the bypass hole is closed in both the case of FIG. 3A and the case of FIG. 3B, it does not matter where the bypass hole is formed. However, during the power saving operation, in the case of FIG. 3A, although an unnecessary compression process is not performed in terms of the compressor, the capacity variation ratio is only 67%. On the contrary, in the case of FIG. 3B, the power saving operation is performed while the bypass hole 51*a* is closed, thus refrigerant to be bypassed is unnecessarily compressed. This results in an unnecessary input load which reduces the efficiency of the compressor, and as a result limits lowering the capacity variation ratio of the compressor.

Moreover, a capacity variable device of the scroll compressor in the related art has a large number of components, including the modulation ring 61, the lift ring 62, and the control valve 63. Additionally, the first communication passage 61*a*, second communication passage 61*b*, and third communication passage 61*c* must be formed on the modulation ring 61 to operate the modulation ring 61, which complicates the structure of the modulation ring 61.

Furthermore, in a capacitor variable device of the scroll compressor in the related art, although the modulating ring 61 should be rapidly floated using the refrigerant of the back pressure chamber 60*a*, the modulation ring 61 is formed in an annular shape and the control valve 63 is engaged with the coupling ring 61, which is problem some for rapidly floating the modulation ring as well as increasing a weight of the modulation ring 61.

SUMMARY OF THE INVENTION

The present invention has been made in order to solve at least the above problems associated with the conventional technology.

An object of the present disclosure is to provide a scroll compressor capable of lowering a capacity variation ratio so as to increase a system efficiency of a refrigeration device to which the compressor is applied.

Another object of the present disclosure is to provide a scroll compressor capable of reducing an input load of the compressor as well as lowering a capacity variation ratio of the compressor.

Another object of the present disclosure is to provide a scroll compressor having a simplified structure of the capacity variable device to reduce manufacturing cost.

Another object of the present disclosure is to provide a scroll compressor having a reduced weight of the capacity variable device so as to rapidly perform capacity variation with a minimal or reduced force applied thereto.

In order to accomplish at least some of the above objectives of the present disclosure, there is provided a scroll compressor in which a pair of two compression chambers are formed by a pair of two scrolls, including a bypass hole capable of bypassing part of refrigerant prior to starting compression against the refrigerant of the compression chamber as well as bypassing part of refrigerant while performing compression against the refrigerant of the compression chamber up to a predetermined crank angle during a power saving operation.

In such exemplary embodiment, a plurality of the bypass holes may be provided at predetermined intervals along a compression advancing direction.

In order to accomplish at least some of the objectives of the present disclosure, there is provided a scroll compressor, including a casing; a compression unit provided in an inner space of the casing to form a compression chamber composed of an inner pocket and an outer pocket by a pair of a first scroll and a second scroll; and bypass holes provided in the compression unit to bypass refrigerant suctioned into the compression chamber to the inner space of the casing to vary compression capacity, wherein the bypass holes are formed in a compression chamber constituting the inner pocket and a compression chamber constituting an outer pocket to be located in compression chambers having different pressures along a movement path of the respective compression chambers.

In such embodiment, the compression chamber may include a first compression chamber constituting the inner pocket and a second compression chamber constituting the outer pocket, and a bypass hole formed in the first compression chamber and a bypass hole formed in the second compression chamber are opened and closed together by the same bypass valve.

The first scroll and the second scroll may be provided with a first wrap and a second wrap engaged with each other to form a compression chamber, and a bypass hole formed in the first compression chamber and a bypass hole formed in the second compression chamber may be spaced apart to have a distance equal to or greater than a wrap thickness of the scroll in which the bypass holes are not formed.

When a crank angle at which compression in the compression chamber is started is 0 degree, the bypass holes may be formed in a compression chamber located at a side of the crank angle less than 360 degrees and a compression chamber located at a side of the crank angle greater than 360 degrees, respectively, with respect to a point at which the crank angle is 360 degrees in each of the pockets.

Additionally, in order to accomplish at least some the objectives of the present disclosure, there is provided a scroll compressor, including a casing; a drive motor provided in an inner space of the casing; a first scroll provided in an inner space of the casing, and coupled to a rotation shaft that transmits a rotational force of the drive motor to perform an orbiting motion; a second scroll engaged with the first scroll to form a compression chamber, and provided with a bypass hole for bypassing refrigerant suctioned into the compression chamber to an inner space of the casing to vary compression capacity; a back pressure chamber assembly provided on a rear surface of the second scroll to form a back pressure chamber so as to pressurize the second scroll toward a first scroll; a first valve assembly provided in the second scroll or the back pressure chamber assembly to selectively open and close the bypass hole according to the operation mode; and a second valve assembly provided at an inside or outside of the casing to operate the first valve assembly, wherein the bypass hole comprises a first bypass hole and a second bypass hole located at different points along an advancing direction of the compression chamber, and the first bypass hole is located within a range of the outermost compression chamber formed at the time point at which the first scroll reaches a compression start angle, and the second bypass hole is located within a range of another compression chamber successively located at the discharge side than the outermost compression chamber at the time point at which the first scroll reaches the compression start angle.

In such embodiment, the first bypass hole and the second bypass hole may be formed with a crank angle of 90° to 270° from each other.

The compression chamber may include a first compression chamber and a second compression chamber, and the first compression chamber may be formed on an inner side with respect to the first wrap provided in the first scroll, and the second compression chamber may be formed on an outer side of the first wrap, and a first bypass hole communicating with the first compression chamber and a second bypass hole communicating with the second compression chamber or a second bypass hole communicating with the first compression chamber and a first bypass hole communicating with the second compression chamber may be formed at intervals equal to or greater than a wrap thickness of the first wrap.

The first valve assembly may include two valve members operated together by the second valve assembly, and a first bypass hole communicating with the first compression chamber and a second bypass hole communicating with the second compression chamber or a second bypass hole communicating with the first compression chamber and a first bypass hole communicating with the second compression chamber may be respectively opened and closed together by one of two valve members constituting the first valve assembly.

In such embodiment, when the crank angle at which compression in the compression chamber is started is 0 degree, the first bypass hole may be formed in a compression chamber in which the crank angle is smaller than 360 degrees, and the second bypass hole may be formed in a compression chamber in which the crank angle is larger than 360 degrees.

A cross-sectional area of the first bypass hole and a cross-sectional area of the second bypass hole may be the same.

A cross-sectional area of the first bypass hole may be formed to be smaller than that of the second bypass hole.

Additionally, in order to accomplish at least some the objectives of the present disclosure, there is provided a scroll compressor in which a compression chamber in which wraps provided in a pair of two scrolls, respectively, are engaged with each other to form a compression chamber, and the compression chamber is spirally wound from the outside to the inside to reduce volume while moving, and a suction port and a discharge port are formed at an outer side and an inner side of one of the pair of two scrolls, and bypass holes are formed between the suction port and the discharge port to allow the refrigerant of the compression chamber to be bypassed prior to reaching the discharge port, and bypass valves for selectively opening and closing the bypass holes to vary the operation mode is provided on the bypass holes, wherein a plurality of the bypass holes are formed to be located at different crank angles along the movement trajectory of each compression chamber, and the plurality of bypass holes are opened and closed by different bypass valves.

In such embodiment, the compression chambers may be independently formed on an inner side and an outer side with respect to either one of wraps, and a plurality of the bypass holes may be formed to be located at different crank angles along the movement trajectory of each compression chamber in a compression chamber located at an inner side thereof and a compression chamber located at an outer side thereof, respectively, and a bypass hole of a compression chamber located on an inner side thereof and a bypass hole of a compression chamber located on an outer side thereof among the plurality of bypass holes may be opened and closed by a pair of the same bypass valves, respectively.

The compression chambers may be independently formed on an inner side and an outer side with respect to either one of wraps, and a plurality of the bypass holes may be formed to be located at different crank angles along the movement trajectory of each compression chamber in a compression chamber located at an inner side thereof and a compression chamber located at an outer side thereof, respectively, and a bypass hole of the compression chamber located on an inner side to have a relatively low pressure and a bypass hole of the compression chamber located on an outer side to have a relatively high pressure among the plurality of bypass holes may be opened and closed at the same time, and a bypass hole of the compression chamber located on an inner side to have a relatively high pressure and a bypass hole of the compression chamber located on an outer side to have a relatively low pressure among the plurality of bypass holes may be opened and closed at the same time.

According to the present disclosure, a plurality of bypass holes may be formed in an inner pocket and an outer pocket, respectively, and the plurality of bypass holes may be arranged at predetermined intervals along a compression advancing direction, thereby greatly reducing a capacity variation ratio of the compressor.

An unnecessary input load may be reduced while lowering the capacity variable ratio through a plurality of bypass holes, thereby increasing compressor efficiency and enhancing the efficiency of a system to which the compressor is applied.

The bypass holes of different pockets may be arranged adjacent to each other to open and close them with a single check valve, thereby simplifying the structure of the capacity variable device to reduce manufacturing cost as well as reducing capacity variation ratio.

A valve for opening and closing the bypass passage of the refrigerant may be configured with a piston valve operated by a small pressure change, thereby quickly and accurately switching the operation mode of the compressor.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Hereinafter, a scroll compressor according to the present disclosure will be described in detail with reference to various embodiments illustrated in the accompanying drawings.

These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Figure 1:
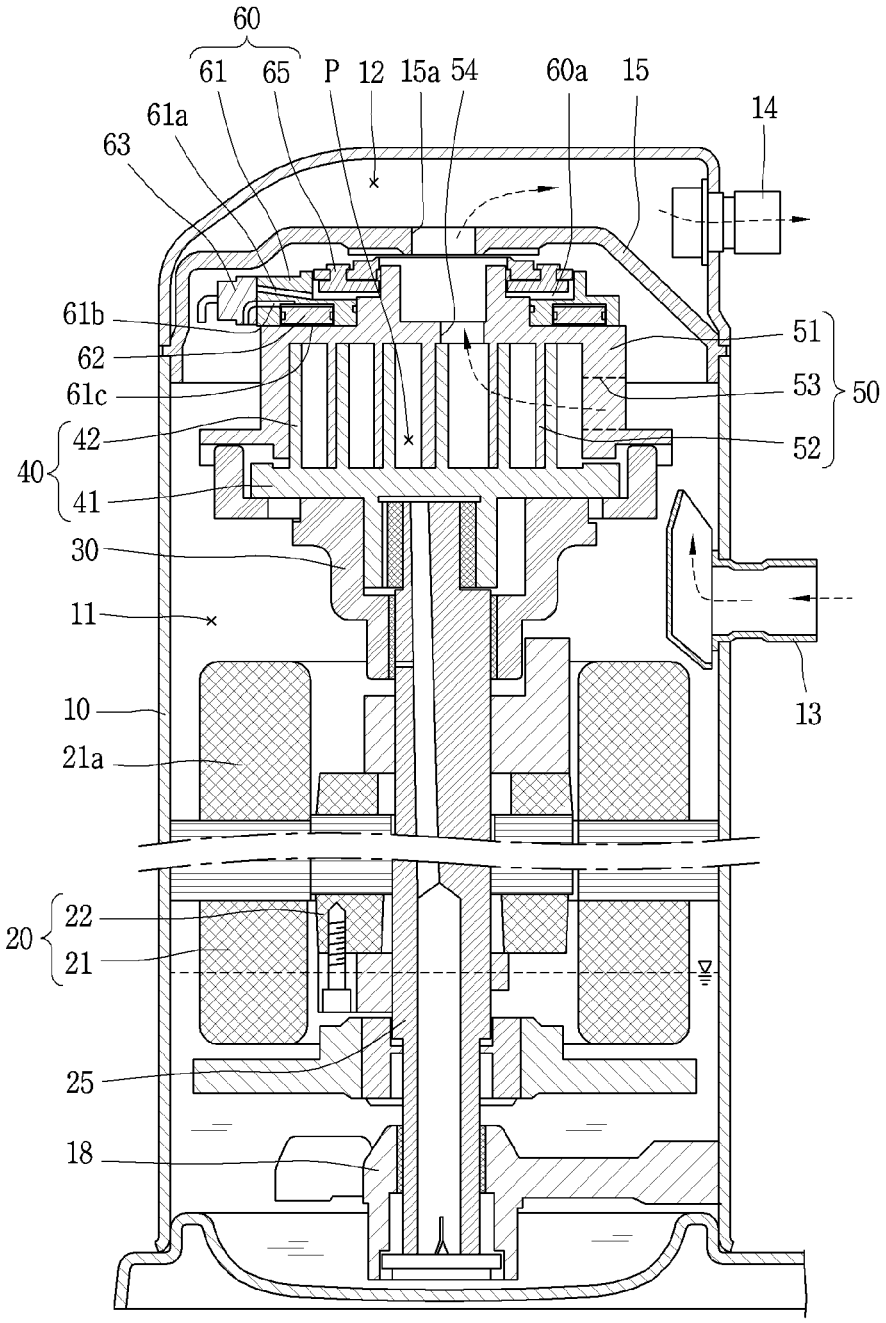
FIG. 1 RELATED ART
FIG. 1 is a longitudinal cross-sectional view illustrating a scroll compressor having a capacity variable device in the related art.
Figure 2A:
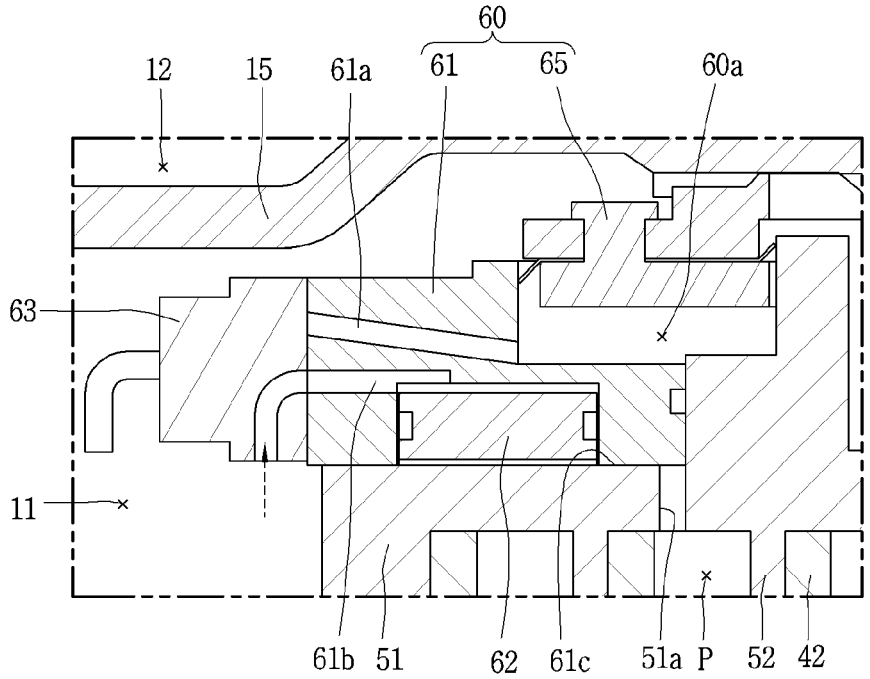
FIG. 2A RELATED ART
FIG. 2A is a longitudinal cross-sectional view illustrating a power operation state using a capacity variable device in the scroll compressor according to FIG. 1.
Figure 2B:
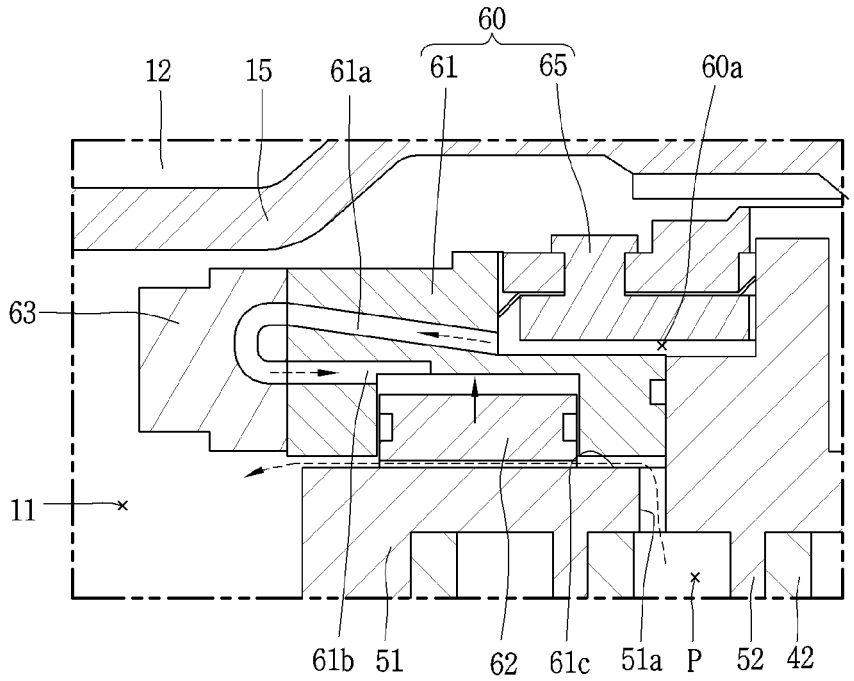
FIG. 2B RELATED ART
FIG. 2B is a longitudinal cross-sectional view illustrating a power saving operation state using a capacity variable device in the scroll compressor according to FIG. 1.
Figure 3A:
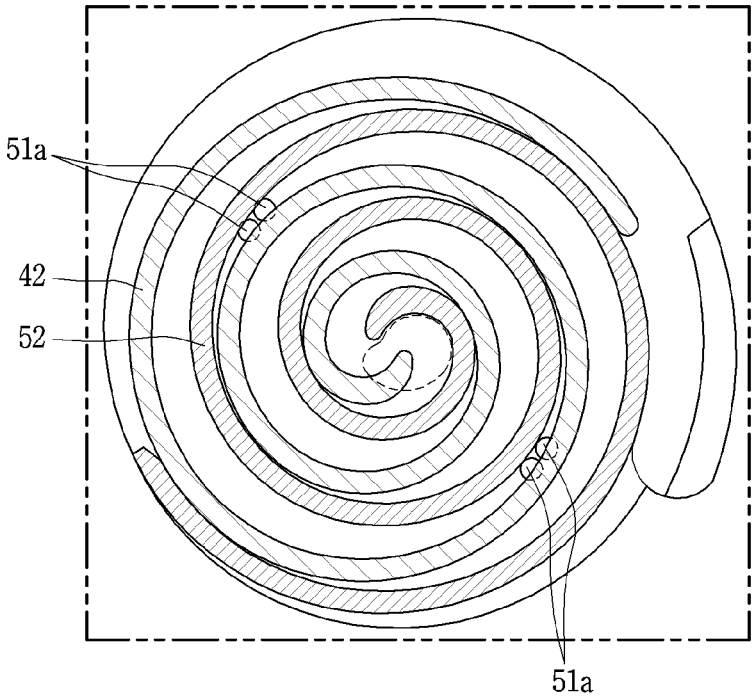
FIG. 3A RELATED ART
FIG. 3A is a plan view illustrating a capacity variation state according to the position of a bypass hole in a scroll compressor in the related art.
Figure 3B:
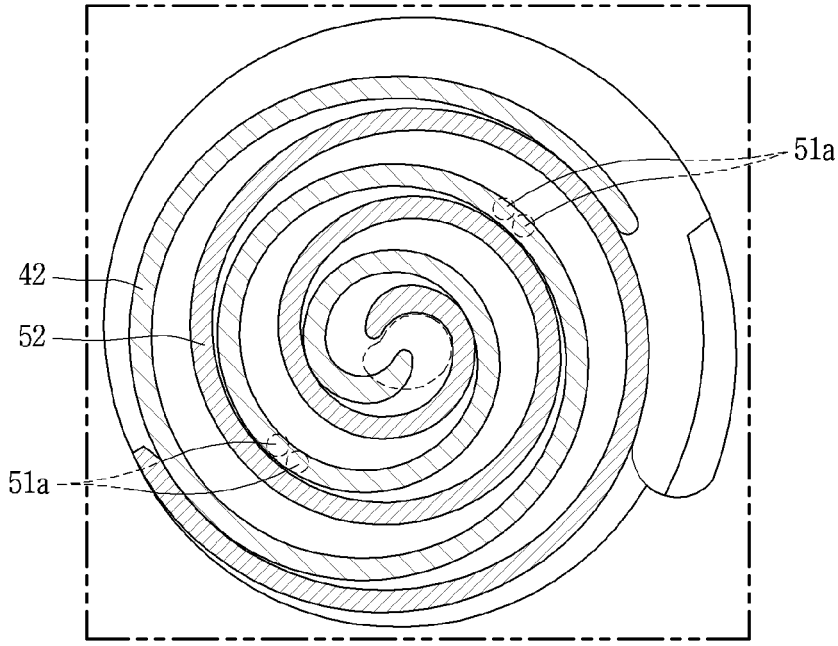
FIG. 3B RELATED ART
FIG. 3B is a plan view illustrating a capacity variation state according to the position of a bypass hole in a scroll compressor in the related art.
Figure 4:
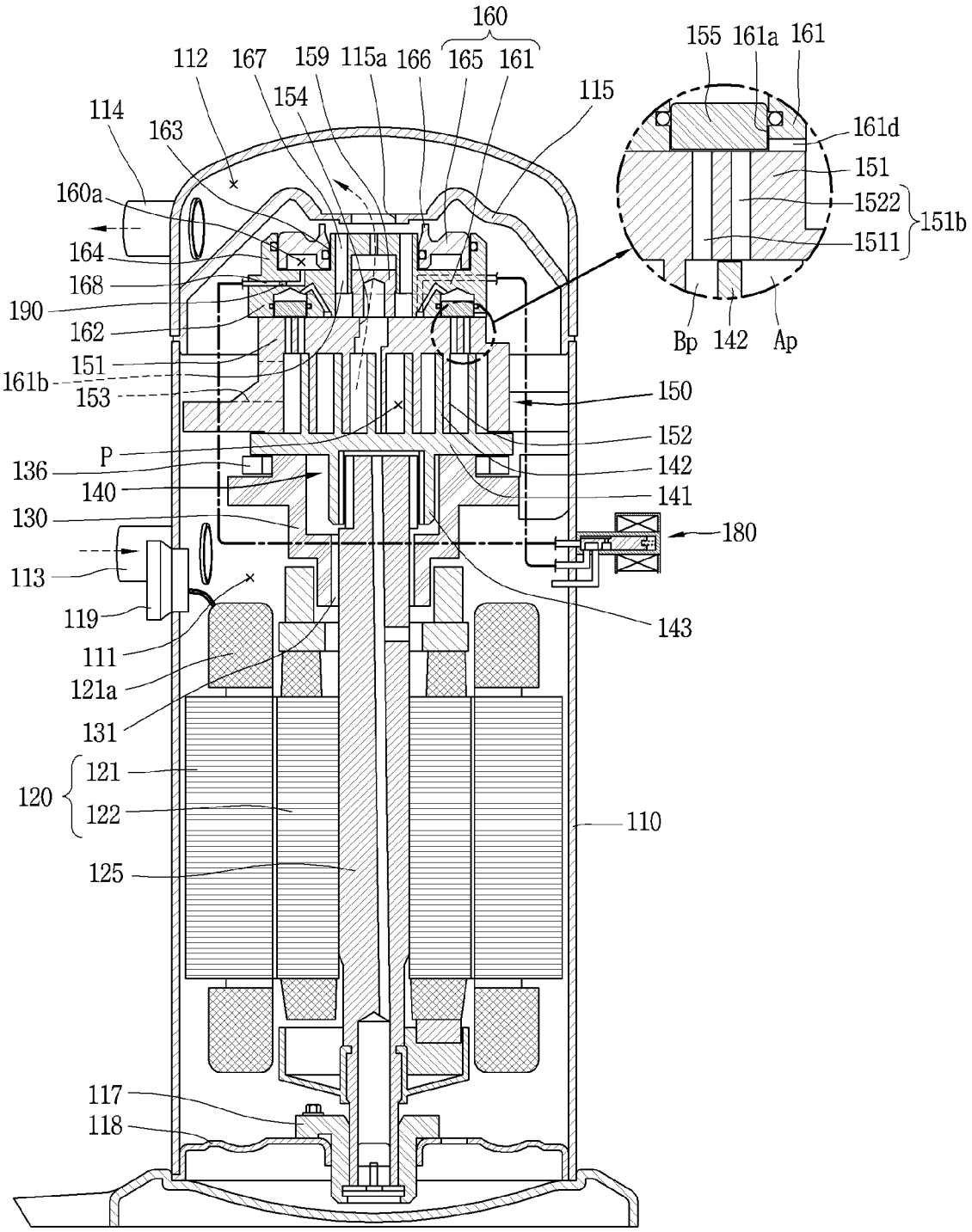
FIG. 4 is a longitudinal cross-sectional view illustrating a scroll compressor having a capacity variable device according to an embodiment of the present disclosure.
Figure 5:
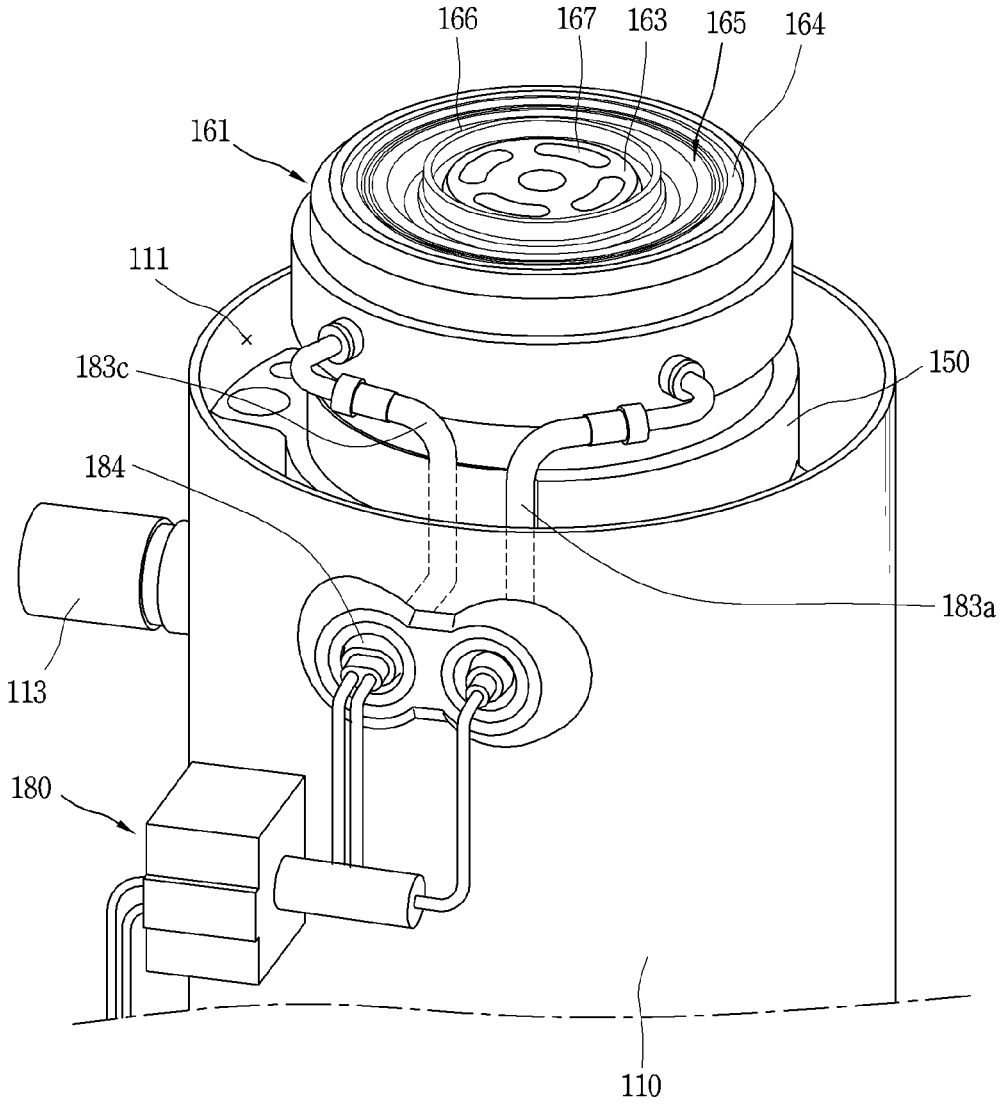
FIG. 5 is a perspective view illustrating a scroll compressor having the capacity variable device according to the embodiment shown in FIG. 4.
Figure 6:
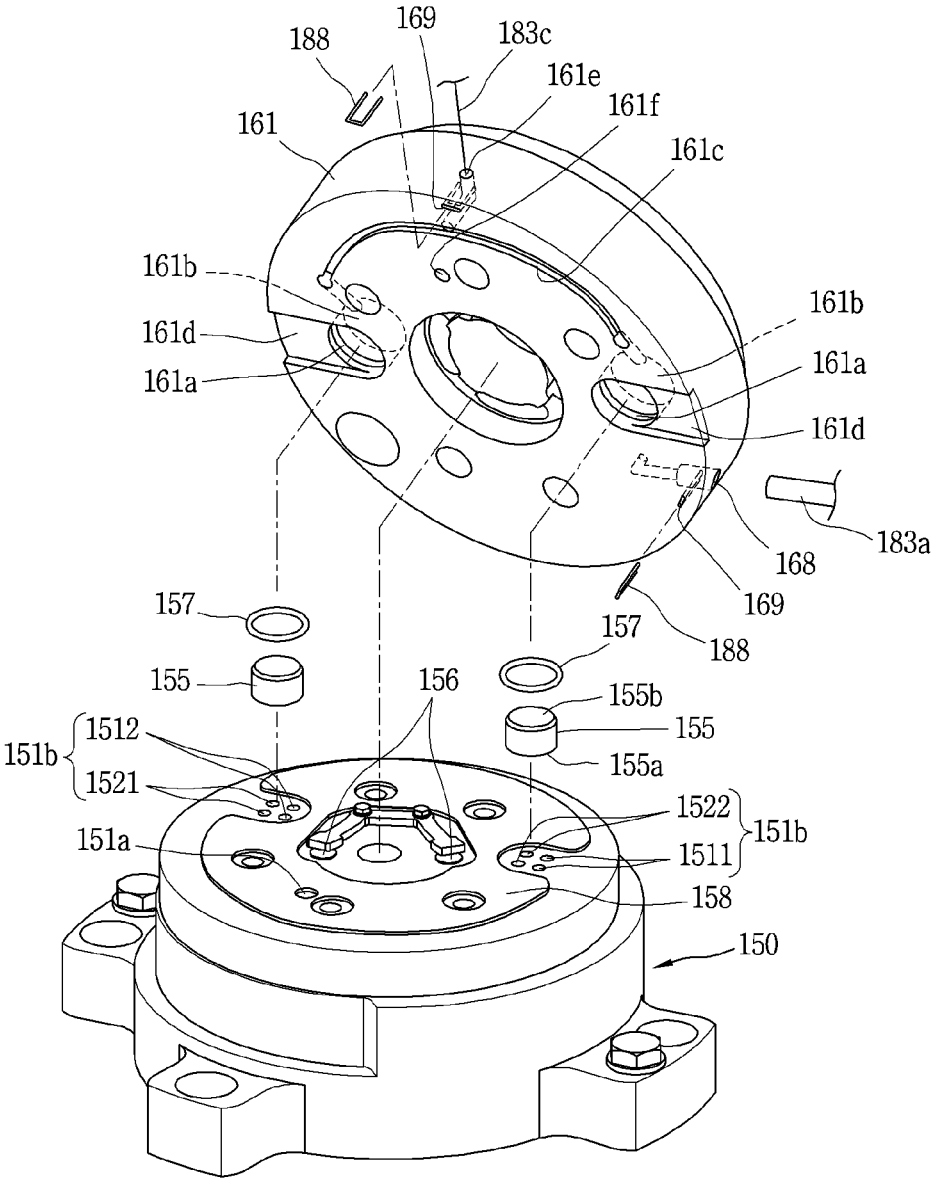
FIG. 6 is an exploded perspective view illustrating the capacity variable device in FIG. 4.
Figure 7:
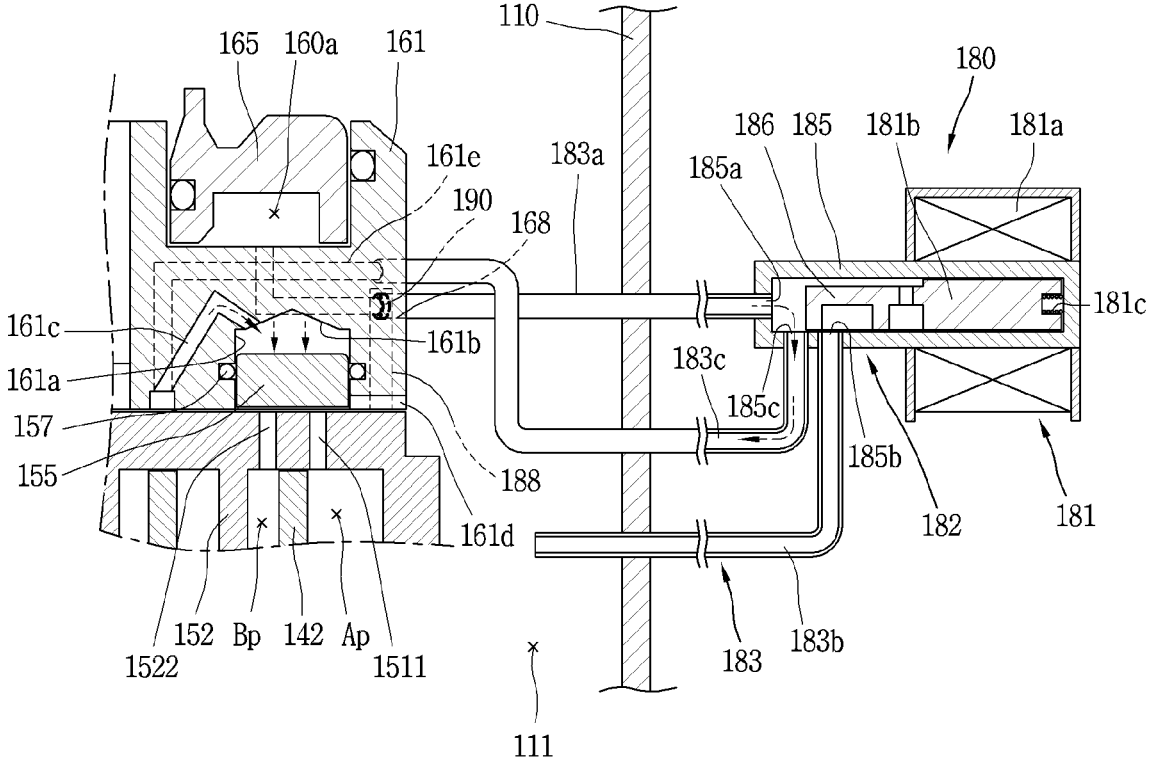
FIG. 7 is an assembled cross-sectional view schematically illustrating a connection state of a check valve and a control valve in the capacity variable device according to the embodiment shown in FIG. 3.
Figure 8:
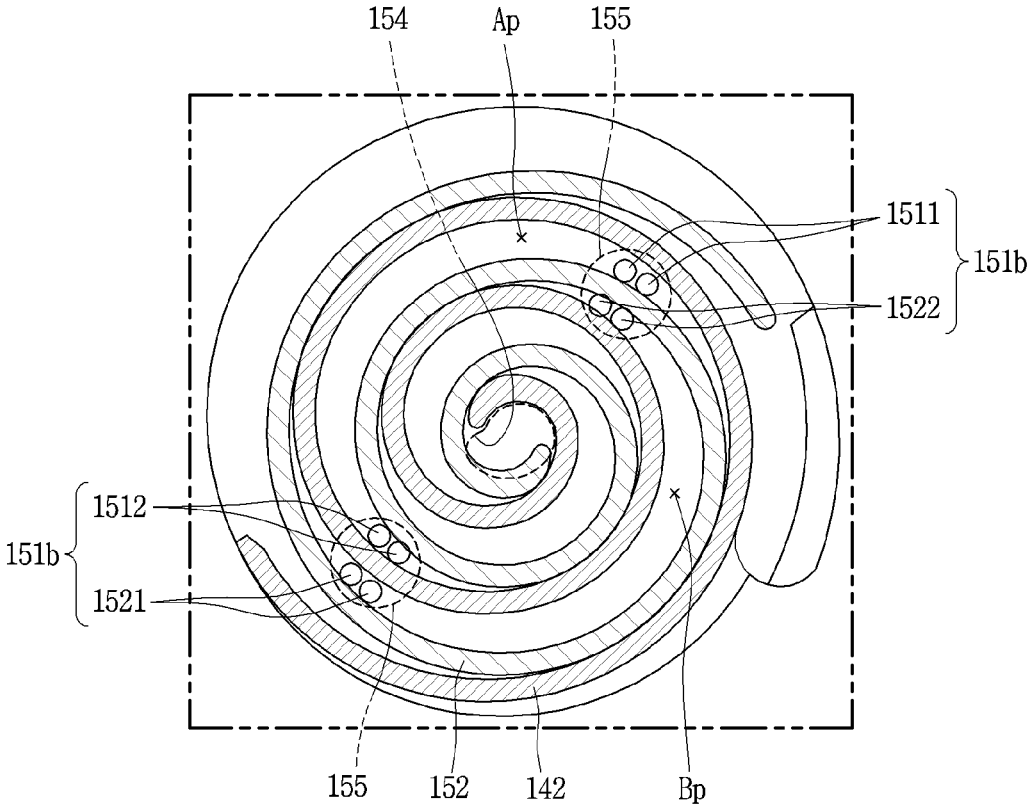
FIG. 8 is a plan view illustrating a first bypass hole and a second bypass hole in the scroll compressor according to an embodiment of the present disclosure.

FIG. 4 is a longitudinal cross-sectional view illustrating a scroll compressor having a capacity variable device according to an embodiment of the present disclosure. FIG. 5 is a perspective view illustrating a scroll compressor having the capacity variable device according to the embodiment shown in FIG. 4. FIG. 6 is an exploded perspective view illustrating the capacity variable device illustrated in FIG. 4. FIG. 7 is an assembled cross-sectional view schematically illustrating a connection state of a check valve and a control valve in the capacity variable device according to the embodiment illustrated in FIG. 3. FIG. 8 is a plan view illustrating a first bypass hole and a second bypass hole in the scroll compressor according to an embodiment of the present disclosure.

As illustrated in FIG. 4, a closed inner space of the casing 110 may be divided into a suction space 111, which is a low pressure portion, and a discharge space 112, which is a high pressure portion, by a high-low pressure separation plate 115 provided at an upper side of a non-orbiting scroll (hereinafter, used interchangeably with a "second scroll") which will be described later. The suction space 111 may correspond to a lower space of the high-low pressure separation plate 115, and the discharge space 112 may correspond to an upper space of the high-low pressure separation plate.

A suction pipe 113 communicating with the suction space 111 and a discharge pipe 114 communicating with the discharge space 112 may be respectively fixed to the casing 110 to suction refrigerant into the inner space of the casing 110 or discharge refrigerant out of the casing 110.

A drive motor 120 having a stator 121 and a rotor 122 may be disposed in the suction space 111 of the casing 110. The stator 121 may be attached to an inner wall surface of the casing 110 in a heat shrinking manner, and a rotation shaft 125 may be inserted and coupled to a central portion of the rotor 122. A coil 121*a* is wound around the stator 121. The coil 121*a* may be electrically connected to an external power source through a terminal 119 which is penetrated and coupled to the casing 110, such as illustrated in FIGS. 4 and 5.

A lower side of the rotation shaft 125 may be rotatably supported by an auxiliary bearing 117 provided below the casing 110. The auxiliary bearing 117 may be supported by a lower frame 118 fixed to an inner surface of the casing 110 to stably support the rotation shaft 125. The lower frame 118 may be welded and fixed to an inner wall surface of the casing 110, and a bottom surface of the casing 110 is used to form an oil storage space. Oil stored in the oil storage space may be transferred to the upper side by the rotation shaft 125 or the like, and the oil enters the driving unit and the compression chamber to facilitate lubrication.

An upper end portion of the rotation shaft 125 may be rotatably supported by the main frame 130. The main frame 130 may be provided on an inner wall surface of the casing 110, such as the lower frame 118, and a downwardly protruding main bearing portion 131 may be formed on a lower surface thereof. The rotation shaft 125 may be inserted into the main bearing portion 131. An inner wall surface of the main bearing portion 131 may function as a bearing surface and supports the rotation shaft 125.

An orbiting scroll (hereinafter, used interchangeably with a "first scroll") 140 is disposed on an upper surface of the main frame 130. The first scroll 140 may include a first end plate portion 141 having a substantially disk shape and an orbiting wrap (hereinafter, referred to as a "first wrap") 142 that is spirally formed at one side surface of the first end plate portion 141. The first wrap 142 may form a compression chamber (P) together with a second wrap 152 of a second scroll 150, which is described below.

The first end plate portion 141 of the first scroll 140 is orbitably driven while being supported by an upper surface of the main frame 130. An oldham ring 136 may be provided between the first end plate portion 141 and the main frame 130 so as to prevent the rotation of the first scroll 140.

A boss portion 143 into which the rotation shaft 125 is inserted may be formed at a bottom surface of the first end plate scroll 141 of the first scroll 140. With such configuration, the first scroll 140 is orbitably driven by a rotational force of the rotation shaft 125.

The second scroll 150 engaging with the first scroll 140 is disposed at an upper portion of the first scroll 140. The second scroll 150 is provided to be movable in an up and down direction (vertically) with respect to the first scroll 140. A plurality of guide pins (not shown) may be inserted into the main frame 130 and placed and supported at an upper surface of the main frame 130 in a state of being inserted into a plurality of guide holes (not shown) formed on an outer circumferential portion of the second scroll 150.

On the other hand, as illustrated in the embodiment shown in FIGS. 4 and 6, an upper surface of a body portion of the second scroll 150 may be formed in a circular plate shape to form a second end plate portion 151, and the second wrap 152 engaging with the first wrap 142 of the foregoing first scroll 140 may be formed in a spiral shape at a lower portion of the second end plate portion 151.

A suction port 153 for suctioning refrigerant existing within the suction space 111 may be formed at a side surface of the second scroll 150, and a discharge port 154 for discharging the compressed refrigerant may be formed in a substantially central portion of the second end plate portion 151.

As described above, the first wrap 142 and the second wrap 152 together form a plurality of compression chambers (P. The compression chambers (P) are orbitably moved to a side of the discharge port 154 while reducing the volume so as to compress refrigerant. Therefore, a pressure of the compression chamber (P) adjacent to the suction port 153 is minimized, a pressure of the compression chamber (P) communicating with the discharge port 154 is maximized, and a pressure of the compression chamber (P) existing there between forms an intermediate pressure having a value between a suction pressure of the suction port 153 and a discharge pressure of the discharge port 154.

The intermediate pressure may be applied to the back pressure chamber 160*a* (described in more detail below) so that the second scroll 150 is pressed toward the first scroll 140, and thus a scroll side back pressure hole 151*a* communicating with one of regions having the intermediate pressure, from which refrigerant is discharged, may be formed on the second end plate portion 151.

A back pressure plate 161 constituting part of the back pressure chamber assembly 160 may be attached to an upper portion of the second end plate portion 151 of the second scroll 150. The back pressure plate 161 may be formed in a substantially annular shape, and has a support plate portion 162 in contact with the second end plate portion 151 of the second scroll 150. For example, the support plate portion 162 may have an annular plate shape with a hollow center, and a plate side back pressure hole 161*f* communicating with the foregoing scroll side back pressure hole 151*a* may be formed to penetrate the support plate portion 162.

First and second annular walls 163, 164 may be formed at an upper surface of the support plate portion 162 so as to surround the inner and outer circumferential surfaces of the support plate portion 162. An outer circumferential surface of the first annular wall 163, an inner circumferential surface of the second annular wall 164, and an upper surface of the support plate portion 162 together may form an annular back pressure chamber 160*a*.

A floating plate 165 constituting an upper surface of the back pressure chamber 160*a* may be provided at an upper side of the back pressure chamber 160*a*. A sealing end portion 166 may be provided at an upper end portion of an inner space portion of the floating plate 165. The sealing end portion 166 may be formed so as to protrude or extend in a upward direction from a surface of the floating plate 165, and its inner diameter may be formed so that it does not cover a portion of the intermediate discharge port 167. The sealing end portion 166 may be in contact with a lower surface of the high-low pressure separation plate 115 so as to seal the discharged refrigerant to be discharged into the discharge space 112 without leaking into the suction space 111.

As shown, the scroll compressor further includes a terminal 119, an opening and closing surface 155*a*, a back pressure surface 155*b*, a bypass valve for opening and closing a discharge bypass hole through which part of refrigerant compressed in the intermediate pressure chamber is bypassed to prevent over-compression 156, an O-ring 157, a check valve 159 for blocking refrigerant discharged to the discharge space from flowing back to the compression chamber (P), and a fixing pin for fixing a connection pipe 188.

The foregoing scroll compressor according to the above described embodiment may operate as follows.

The rotation shaft 125 rotates together with the rotor 122 when power is applied to the stator 121.

Then, the first scroll 140 coupled to an upper end portion of the rotation shaft 125 performs an orbiting motion with respect to the second scroll 150 so as to form a pair of two compression chambers (P). The pair of two compression chambers (P) have a reduction in volume while moving directionally from the outside to the inside, respectively, to suction, compress, and discharge refrigerant.

At this time, part of refrigerant moving along the trajectory of the compression chamber (P) moves to the back pressure chamber 160*a* through the scroll side back pressure hole 151*a* and the plate side back pressure hole 161*f* before reaching the discharge port 154. Accordingly, the back pressure chamber 160*a* formed by the back pressure plate 161 and the floating plate 165 forms an intermediate pressure.

As a result, the floating plate 165 is brought into close contact with the high-low pressure separation plate 115 while receiving a pressure in an upward direction, and the discharge space 112 and the suction space 111 of the casing are then separated from each other so as to prevent or substantially limit refrigerant discharged to the discharge space 112 from leaking to the suction space 111. On the contrary, the back pressure plate 161 receives a downward pressure so as to pressurize the second scroll 150 in the first scroll direction. The second scroll 150 is then brought into close contact with the first scroll 140 so as to prevent refrigerant compressed in the compression chamber (P) from leaking between the first scroll 140 and the second scroll 150.

Consequently, a series of processes for allowing refrigerant suctioned into the suction space 111 of the casing 110 to be compressed in the compression chamber (P) and discharged to the discharge space, and allowing refrigerant discharged to the discharge space to be circulated in the refrigeration cycle, and then suctioned again into the suction space 111 are repeated.

The scroll compressor described above may also be provided with a capacity variable device capable of performing a full load operation (hereinafter, a power operation) or a partial load operation (a power saving operation) according to the requirements of a system to which the compressor is applied. The capacity variable device may be configured such as illustrated in the embodiments illustrated in FIGS. 4, 5, and 6.

A capacity variable bypass hole (hereinafter, abbreviated as a bypass hole) 151*b* communicating with the intermediate pressure chamber may be formed on the second end plate portion 151 of the second scroll 150 from a lower surface constituting an intermediate pressure chamber to a rear surface at an outside of the compression chamber (P) through the outer back surface.

The bypass holes 151*b* may be formed at intervals of 180 degrees at both sides on an inner pocket constituting a first compression chamber (P) and an outer pocket constituting a second compression chamber (P) with respect to the first wrap to bypass intermediate pressure refrigerant at the same pressure. However, when it is asymmetric in which a wrap length of the first wrap 142 is larger than that of the second lap 152 by 180 degrees, the same pressure is formed at the same crank angle in the inner pocket and the outer pocket, and thus two bypass holes 151*b* may be formed at the same crank angle or only one second bypass hole 151*b* may be formed.

A bypass valve 155 for selectively opening and closing the bypass hole 151*b* in accordance with the operation mode of the compressor to perform a power operation or power saving operation may be provided at an end portion of the bypass hole 151*b*. For example, the bypass valve 155, which may constitute a first valve assembly, may be a check valve configured with a piston valve slidably provided in a valve space 161*a* of a valve plate 161 (described in more detail below) to open and close the bypass hole while moving in an upward and downward direction (vertical) in the valve space 161*a* according to a pressure of the intermediate pressure chamber.

A plurality of the valve spaces 161*a* may be formed at a lower surface of the back pressure plate 161, and a differential pressure space 161*b* having a predetermined volume 161*b* may be formed at a side surface of each bypass valve 155, e.g., at a rear side surface of each bypass valve 155. Preferably, a transverse cross-sectional area of the differential pressure space 161*b* is larger than that of the bypass hole 151*b*.

The differential pressure spaces 161*b* may be formed both sides with a phase difference of 180 degrees together with the valve space 161*a*. Both the differential pressure spaces 161*b* may communicate with each other via a connection passage groove 161*c* formed at a lower surface of the back pressure plate 161.

Both ends of the connection passage groove 161*c* may be formed so as to be inclined directionally toward the respective differential pressure spaces 161*b*. Preferably, the connection passage groove 161*c* is overlapped with a gasket 158 provided on an upper surface of the non-orbiting scroll 150 so as to seal the connection passage groove 161*c*.

An intermediate pressure hole 168 may be formed at the back pressure plate 161 so as to penetrate from a bottom surface of the back pressure chamber 160*a* to an outer circumferential surface thereof, and one end of the intermediate pressure hole 168 may communicate with a differential pressure space 161*b* through the connection passage groove 161*c*, and the other end thereof may be connected to a connection pipe 183*a* (described in more detail below). As a result, a portion of refrigerant in the back pressure chamber 160*a* may be supplied to a rear surface of the bypass valve 155 through the intermediate pressure hole 168 and the first connection pipe 183*a*. Consequently, a rear surface of the bypass valve 155 may be selectively supplied with refrigerant at an intermediate pressure by the second valve assembly 180 (described in more detail below).

A plurality of exhaust grooves 161*d* for communicating each bypass hole 151*b* with the suction space 111 of the casing 110 may be formed at a lower surface of the back pressure plate 161 so as to independently communicate with each bypass hole 151*b*.

The exhaust groove 161*d* may be formed in a radial direction from an inner circumferential surface of the valve space 161*a* toward an outer circumferential surface of the back pressure plate 161, and an outer circumferential surface of the exhaust groove 161*d* may be formed to be open so as to communicate with an inner space of the casing 110.

Accordingly, when each bypass valve 155 is open, refrigerant in the intermediate compression chamber (P) is exhausted to the suction space 111 of the casing 110 through each of the bypass holes 151*b* and the exhaust groove 161*d*. As a result, because both the bypass holes 151*b* communicate independently with the suction space 111 of the casing 110 through the respective exhaust grooves 161*d*, refrigerant bypassed from the compression chamber (P) through both the bypass holes 151*b* may be directly discharged into the suction space 111 of the casing 110 without being merged into one place, thereby suppressing refrigerant bypassed from the compression from being heated by the refrigerant of the back pressure chamber 160*a*. Additionally, when the refrigerant bypassed from the compression chamber to the suction space 111 of the casing 110 is heated, a volume ratio thereof may increase to suppress a suction volume from being reduced.

On the other hand, a differential pressure hole 161*e* is formed at the center of the coupling channel groove 161*c*, and a third connection pipe 183*c* (described in more detail below), is connected to the differential pressure hole 161*e*. However, the differential pressure hole 161*e* may be directly connected to either one of the both differential pressure spaces 161*b*, and the other differential pressure space 161*b* may be communicated through the connection passage groove 161*c*. Here, although not shown in the drawings, the valve space, the differential pressure space, the exhaust groove including the connection passage groove may be formed on an upper surface of the non-orbiting scroll instead of on a lower surface of the back pressure plate 161.

The differential pressure hole 161*e* may be connected to the control valve 180 constituting the third valve through the third connection pipe 183*c*. The control valve 180 may include a solenoid valve and be provided in an inner space of the casing 110. Alternatively, the control valve 180 may be provided at an outside of the casing 110.

The control valve 180 may be attached to an outer circumferential surface of the casing 110 using a bracket

180*a* or similar attachment structure. Alternatively, the control valve 180 may be directly welded to the casing 110 without using a separate bracket or attachment structure.

The control valve 180 may include a solenoid valve having a power supply unit 181 connected to external power so as to selectively operate a mover 181*b* depending on whether the external power is applied thereto.

As shown, the power supply unit 181 may be provided with a mover 181*b* inside a coil 181*a* to which power is supplied, and a return spring 181*c* may be provided at one end of the mover. The mover 181*b* may be coupled to a switching valve 186 for communicating between a first input/output port 185*a* and a third input/output port 185*c*, or for connecting between the second input/output port 185*b* and the third input/output port 185*c*, which is described in more detail below.

Accordingly, when power is supplied to the coil 181*a*, the mover 181*b* and the valve 186 that is coupled to the mover 181*b* move in a first direction (e.g., exhaust hole closing direction) so as to connect the corresponding connection pipes 183*a*, 183*c* to each other. Alternatively, when power is turned off, the mover 181*b* connects the other connection pipes 183*b*, 183*c* to each other while returning in a second direction (e.g., exhaust hole opening direction) by the return spring 181*c*. As a result, refrigerant directed to the bypass valve 155, which functions as a check valve, is switched in accordance with the operation mode of the compressor.

On the other hand, a valve portion 182 for switching a flow direction of refrigerant while being operated by the power supply unit 181 may be coupled to one side of the power supply unit 181. The valve portion 182 may be configured in such a manner that the switching valve 186 extending to the mover 181*b* of the power supply unit 181 is slidably inserted into a valve housing 185 coupled to the power supply unit 181. Depending on the configuration of the power supply unit 181, the switching valve 186 may change the flow direction of refrigerant while rotating without performing a reciprocating motion. In the present embodiment, for example, a linear reciprocating valve will be mainly described for the sake of convenience of explanation (not limited thereto).

The valve housing 185 may be formed having an elongated cylindrical shape, and multiple input/output ports may be formed along a longitudinal direction. For example, a first input/output port 185*a* may be connected to the back pressure chamber 160*a* through a first connection pipe 183*a*, and a second input/output port 185*b* may be connected to the suction space 111 of the casing 110 through a second connection pipe 183*b*, and a third input/output port 185*c* may be connected to the differential pressure space 161*b* formed on one side surface of the bypass valve 155 through a third connection pipe 183*c*. Though it is illustrated an example in which the first input/output port 185*a* and the second input/output port 185*b* are located at both sides and the third input/output port 185*c* is located at the center, such positioning may vary according to the configuration of the valve.

In order for the first input/output port 185*a* of the control valve 180 to be connected to the back pressure chamber 160*a* through the first connection pipe 183*a*, the intermediate pressure hole 168 passing through an outer circumferential surface of the back pressure chamber 161 or an outer circumferential surface of the second scroll 150 from the back pressure chamber 160*a* should be formed. The intermediate pressure hole 168 may be formed to penetrate from a bottom surface of the back pressure chamber 160*a* to an outer circumferential surface of the back pressure plate 161.

The valve portion 182 may be coupled to a connection portion 183 coupled through the casing 110 so as to transfer the refrigerant switched by the valve portion 182 to the differential pressure space 161*b*.

The connection portion 183 may include a first connection pipe 183*a*, a second connection pipe 183*b*, and a third connection pipe 183*c* to selectively inject refrigerant at an intermediate pressure or suction pressure into a first valve assembly 170.

The first connection pipe 183*a*, the second connection pipe 183*b*, and the third connection pipe 183*c* may be welded (not limited thereto) and coupled to the casing 110 through the casing 110. Furthermore, each connection pipe may be formed of the same or different material as that of the casing 110. In the case of a material different from that of the casing, an intermediate member may be used in consideration of welding to the casing.

The bypass hole may be formed at only one place for every compression chamber. However, in this case, as described above, it is advantageous to control the capacity variable ratio to be low in the aspect of a load of an air conditioner. However, in the aspect of the efficiency of the compressor, it may not be advantageous to place the bypass hole at a position where the capacity variation ratio is low, namely, too far from the suction completion point compared to a position where the capacity variable amount is large. However, it is undesirable to place the position of the bypass hole at a position where the capacity variation ratio is high, namely, too close to the suction completion point, in the aspect of the overall system efficiency of the refrigeration cycle to which the compressor is applied.

Therefore, according to the present embodiment, it is understood that the bypass holes may be formed at a plurality of positions for each compression chamber in consideration of both the system efficiency and the compressor efficiency. For example, for the bypass hole, when a capacity variable bypass hole close to the suction port is referred to as a first bypass hole, and a capacity variable bypass hole away from the suction port is referred to as a second bypass hole with respect to the suction completion point (for convenience, described as a suction port), the first bypass hole and the second bypass hole may be formed at intervals of a predetermined crank angle, respectively, for each compression chamber.

As illustrated in FIGS. 7 and 8, the bypass holes 151*b* may be formed to formed to form a pair of a first bypass hole (hereinafter, an inner first bypass hole) 1511 communicating with the first compression chamber (Ap) constituting an inner pocket, and a second bypass hole (hereinafter, an outer second bypass hole) 1522 communicating with the second compression chamber (Bp) constituting an outer pocket, and form a pair of a second bypass hole (hereinafter, an inner second bypass hole) 1512 communicating with the first compression chamber (Ap) constituting an inner pocket, and a first bypass hole (hereinafter, an outer first bypass hole) 1521 communicating with the second compression chamber constituting an outer pocket.

The inner first bypass hole 1511 may be formed to be located on the suction side (outer side) compared to the inner second bypass hole 1512, and the outer first bypass hole 1521 may be formed to be located on the suction side (outer side) compared to the outer second bypass hole 1522. Accordingly, with respect to the first compression chamber (it is the same in the case of the second compression chamber which is an outer pocket), the first bypass hole 1511 may be formed within a range of the outermost compression chamber in which the inner pocket may be formed at a compression start angle, and the second bypass hole 1512 may be formed within a range of the second compression chamber at the suction end formed successively from the outermost compression chamber.

A distance between the first bypass hole 1511 and the second bypass hole 1512 may be preferably formed within a range of approximately 90° to 270° based on the crank angle, but may be formed with a crank angle of about 180 degrees. Accordingly, the inner first bypass hole 1511 and the outer second bypass hole 1522 form a pair, and the inner second bypass hole 1512 and the outer first bypass hole 1521 also form a pair. When the bypass hole of the inner pocket and the bypass hole of the outer pocket are respectively paired, it may be possible to open and close the two bypass holes paired with a single check valve among check valves configured with bypass valves. This may reduce the cost as well as the required space, thereby achieving the miniaturization of the compressor.

The process of varying the capacity of the compressor in a scroll compressor according to an embodiment of present disclosure will be operated as follows.

Figure 9A:
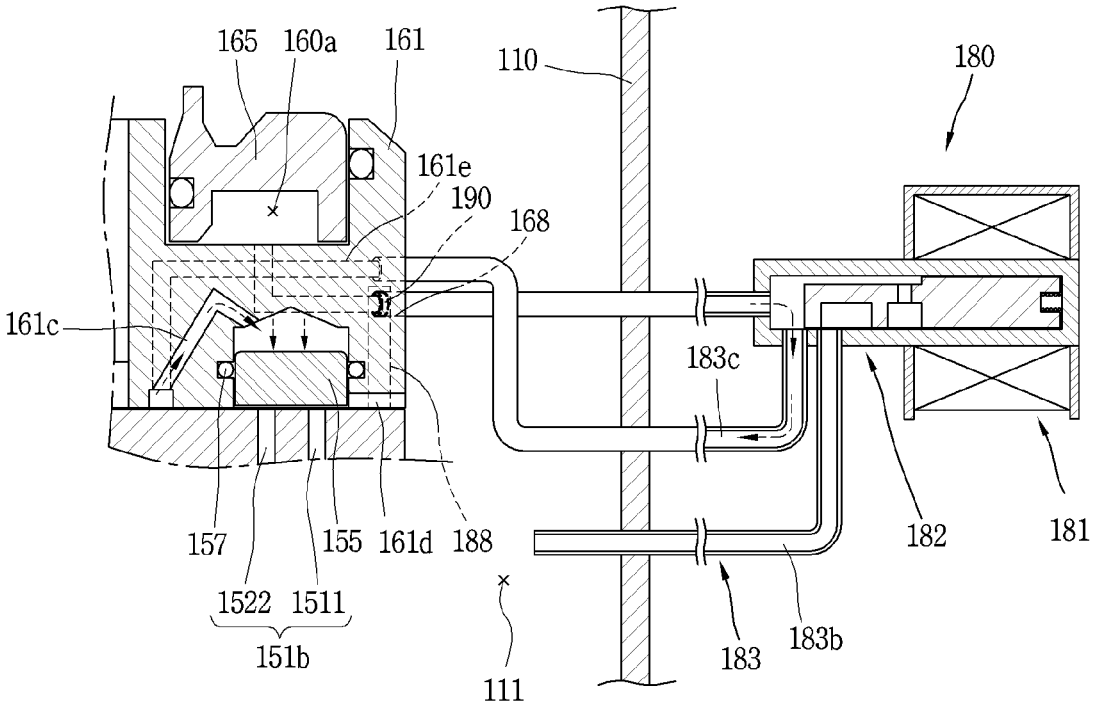
FIG. 9A is a schematic views illustrating the operation of a first valve assembly and a second valve assembly according to the operation mode of the compressor in FIG. 4, when in a power mode.

First, as illustrated in FIG. 9A, when the compressor is operated in a power operation or mode, refrigerant at an intermediate pressure may flow into the differential hole 161*e* through the first connection pipe 183*a*, and the third connection pipe 183*c* by the control valve 180, and the refrigerant flowing into the first differential pressure hole 161*e* may be supplied to both the differential pressure spaces 161*b* through the connection passage groove 161*c*.

Then, a pressure of the differential pressure space 161*b* pressurizes the back pressure surface 155*b* of the bypass valve 155 while forming an intermediate pressure. At this time, since a transverse cross-sectional area of the differential pressure space 161*b* is larger than that of the bypass hole 151*b*, both the bypass valves 155 are pressed against the pressure of the differential pressure space 161*b* to block the respective bypass holes 151*b*. Here, the inner first bypass hole 1511 and the outer second bypass hole 1522 are blocked by one bypass valve 155, and the outer first bypass hole 1521 and the inner second bypass hole 1521 are blocked by the other bypass valve 155.

With such configuration, refrigerant in the compression chamber will not leak to both the bypass holes 151*b*.

Figure 9B:
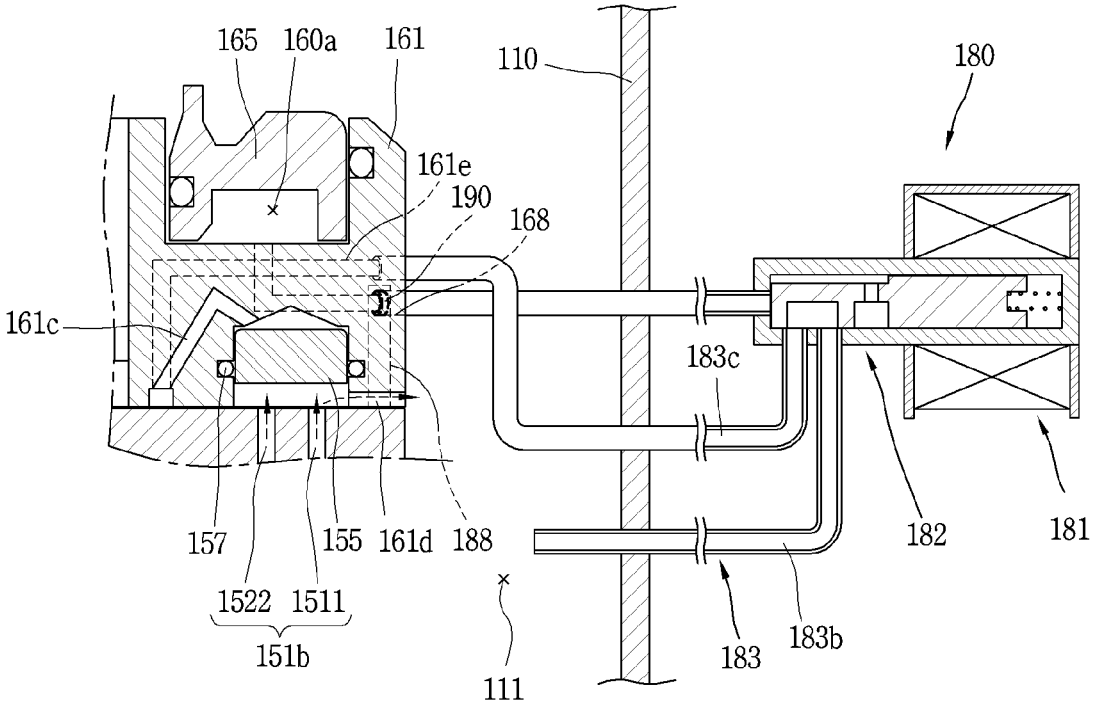
FIG. 9B is a schematic views illustrating the operation of a first valve assembly and a second valve assembly according to the operation mode of the compressor in FIG. 4, when in a power saving operation.

Alternatively, as illustrated in FIG. 9B, when the compressor is operated in a power saving operation, refrigerant at a suction pressure flows into the differential hole 161*e* through the second connection pipe 183*b*, and the third connection pipe 183*c* by the control valve 180, and the refrigerant flowing into the first differential pressure hole 161*e* flows into both the differential pressure spaces 161*b* through the connection passage groove 161*c*.

Then, a pressure of the differential pressure space 161*b* pressurizes the back pressure surface 155*b* of the bypass valve 155 while forming a suction pressure. At this time, as a pressure of the intermediate compression chamber is greater than the pressure in the differential pressure space 161*b*, both the bypass valves 155 are respectively pushed and raised by the pressures of the first compression chamber (Ap) and the second compression chamber (Bp) through the inner first bypass hole 1511 and the outer second bypass hole 1522.

Then, as refrigerant flows into the suction space 111 of the casing 110 through the respective exhaust grooves 161*d* in the respective intermediate compression chambers (Ap, Bp) while opening both the second bypass holes 151*b*, the compressor performs a power saving operation.

Figure 10A:
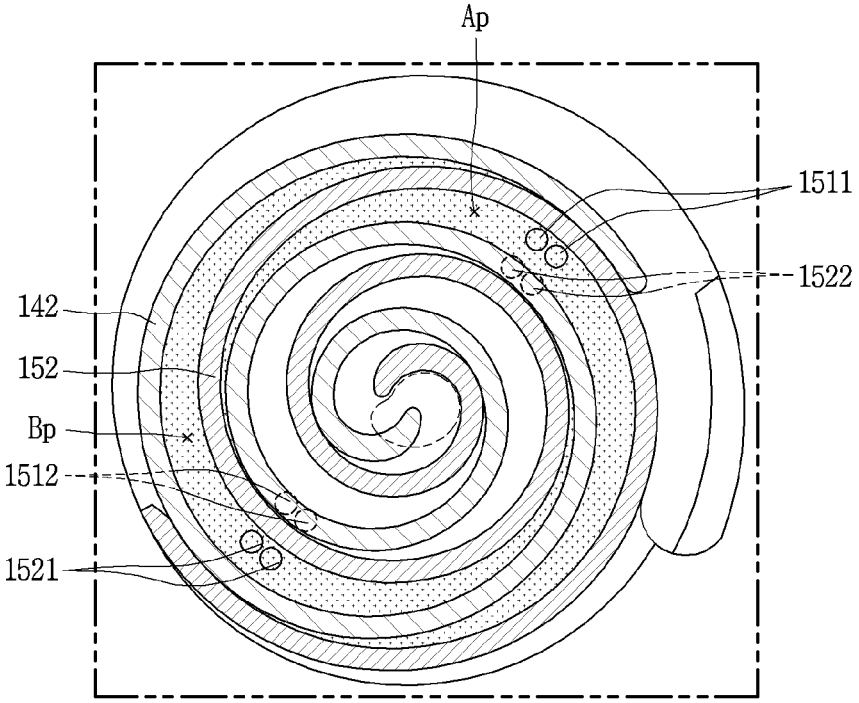
FIG. 10A is a plan view illustrating a capacity variation state according to compression advance in a scroll compressor according to an embodiment of the present disclosure.

At this time, as illustrated in FIG. 10A, when the first wrap 142 of the first scroll 140 reaches the suction completion point, the first bypass hole 1511 communicating with the outermost first compression chamber (Ap) and the first bypass hole 1521 communicating with the outer second compression chamber (Bp) are in an open state. Therefore, even when the first scroll 140 performs a compression stroke for the outermost first compression chamber (Ap) and the outermost second compression chamber (Bp) while performing an orbiting motion, refrigerant suctioned into the outermost first compression chamber (Ap) and the outermost second compression chamber (Bp) is leaked out of the compression chamber through the respective first bypass holes 1511, 1521. Accordingly, it may be possible to prevent an unnecessary input load on the outermost first compression chamber (Ap) and the outermost second compression chamber (Bp) during power saving operation from being increased.

Figure 10B:
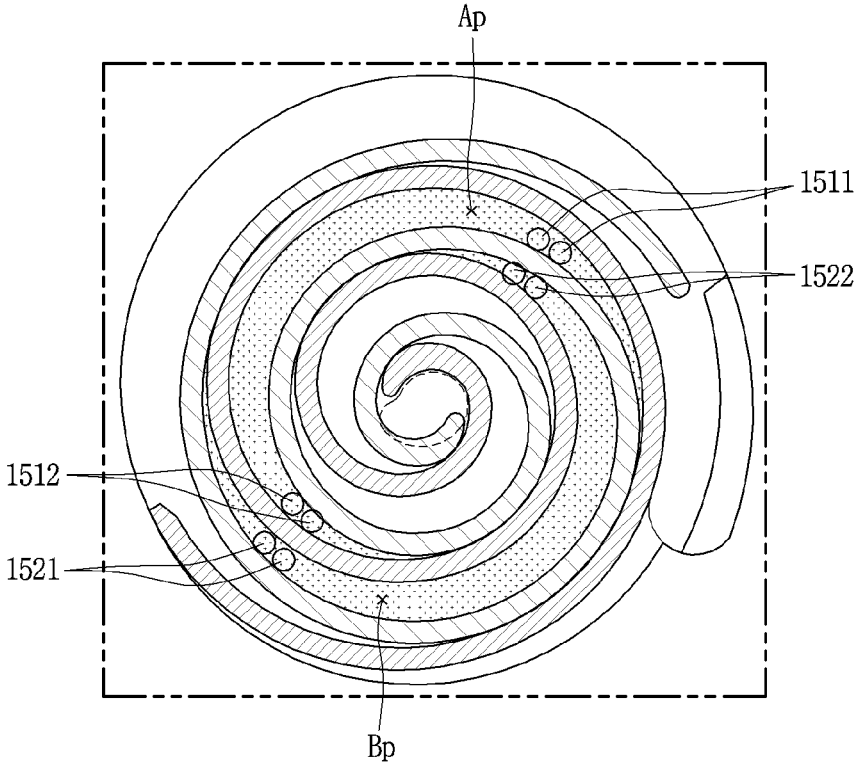
FIG. 10B is a plan view illustrating a capacity variation state according to compression advance in a scroll compressor according to an embodiment of the present disclosure.
Figure 10C:
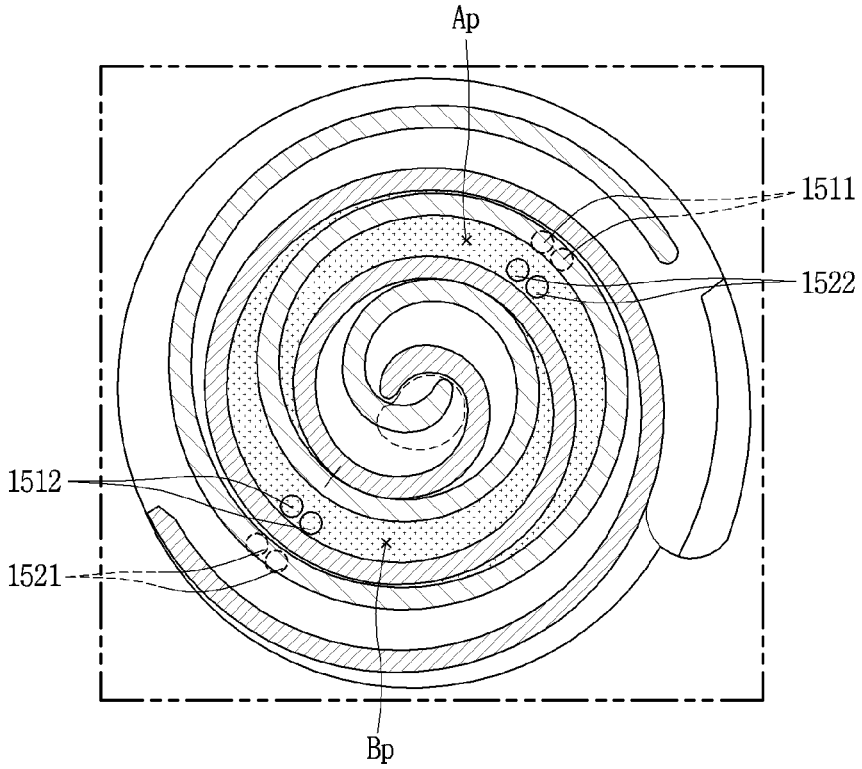
FIG. 10C is a plan view illustrating a capacity variation state according to compression advance in a scroll compressor according to an embodiment of the present disclosure.

Furthermore, as illustrated in FIG. 10B, when the first scroll 140 further advances the compression stroke to reach a position of about 110 degrees, the first bypass holes 1511, 1521 and the second bypass holes 1512, 1522 in each of the compression chambers (Ap, Bp) are simultaneously in an open state. Therefore, refrigerant suctioned into each compression chamber may greatly reduce compression capacity while a large amount of refrigerant is bypassed through each of the first bypass holes 1511, 1521 and the second bypass holes 1512, 1522.

Figure 10D:
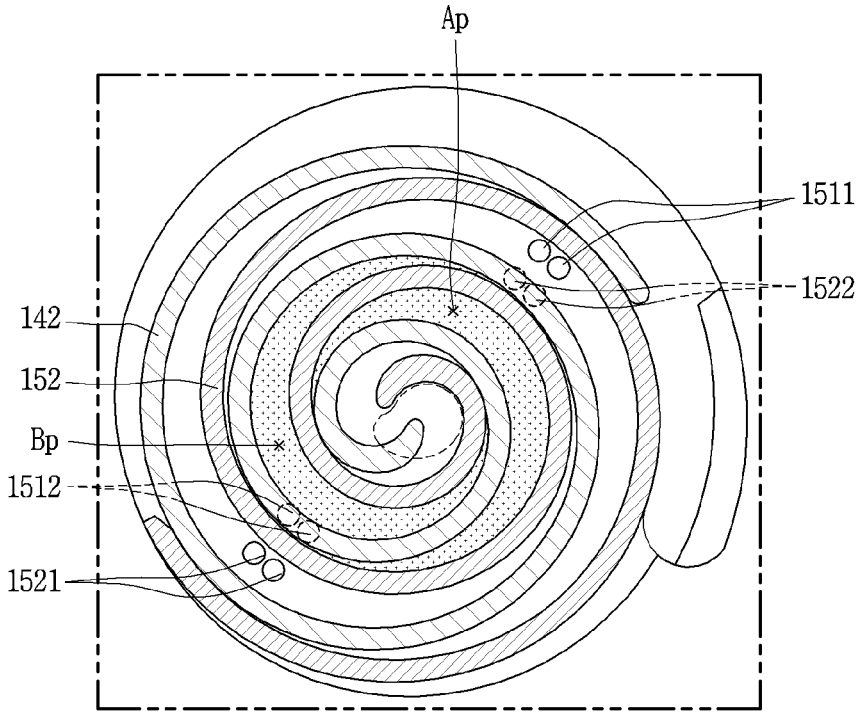
FIG. 10D is a plan view illustrating a capacity variation state according to compression advance in a scroll compressor according to an embodiment of the present disclosure.

Furthermore, as illustrated in FIG. 100, when the first scroll 140 further advances the compression stroke to reach a position of about 250 degrees, the first bypass holes 1511, 1521 in each of the compression chambers (Ap, Bp) are closed, but the second bypass holes 1512, 1522 located further inside than the first bypass holes 1511, 1521 (i.e., on the discharge side with respect to the crank angle) are in an open state. Therefore, in the event refrigerant moves to the second compression chamber adjacent to the outermost compression chamber, refrigerant in each compression chamber (Ap, Bp) is bypassed to an outside of the compression chamber through the second bypass holes 1512, 1522. Accordingly, as illustrated in FIG. 10D, the time at which refrigerant is substantially compressed may be pushed further toward the discharge port and started from the time point at which the refrigerant has passed the second bypass hole, thereby significantly reducing capacity variation ratio.

As a result, a plurality of bypass holes may be formed in an inner pocket and an outer pocket, respectively, and the plurality of bypass holes may be arranged at predetermined intervals along a compression advancing direction, thereby significantly reducing a capacity variation ratio of the compressor.

Furthermore, according to the above configuration, an unnecessary input load may be reduced while lowering the capacity variable ratio through a plurality of bypass holes, thereby increasing compressor efficiency and enhancing the efficiency of a system to which the compressor is applied.

Additionally, according to the above configuration, the bypass holes of different pockets may be arranged adjacent to each other to open and close them with a single check valve, thereby simplifying the structure of the capacity variable device to reduce manufacturing cost as well as reducing capacity variation ratio.

Moreover, according to the above configuration, a valve for opening and closing a bypass passage of refrigerant may be configured with a bypass valve operated by a small pressure change, thereby quickly and precisely switching the operation mode of the compressor.

Meanwhile, another embodiment of the scroll compressor having a capacity variable device according to an embodiment of the present disclosure will be described as follows.

In the above-described embodiment, a check valve is provided between the non-orbiting scroll and the back pressure plate, and a control valve for controlling the check valve is provided at an outside of the casing and connected to a plurality of connection pipes, but according to the present embodiment, the control valve is provided at an inside of the casing.

Figure 11:
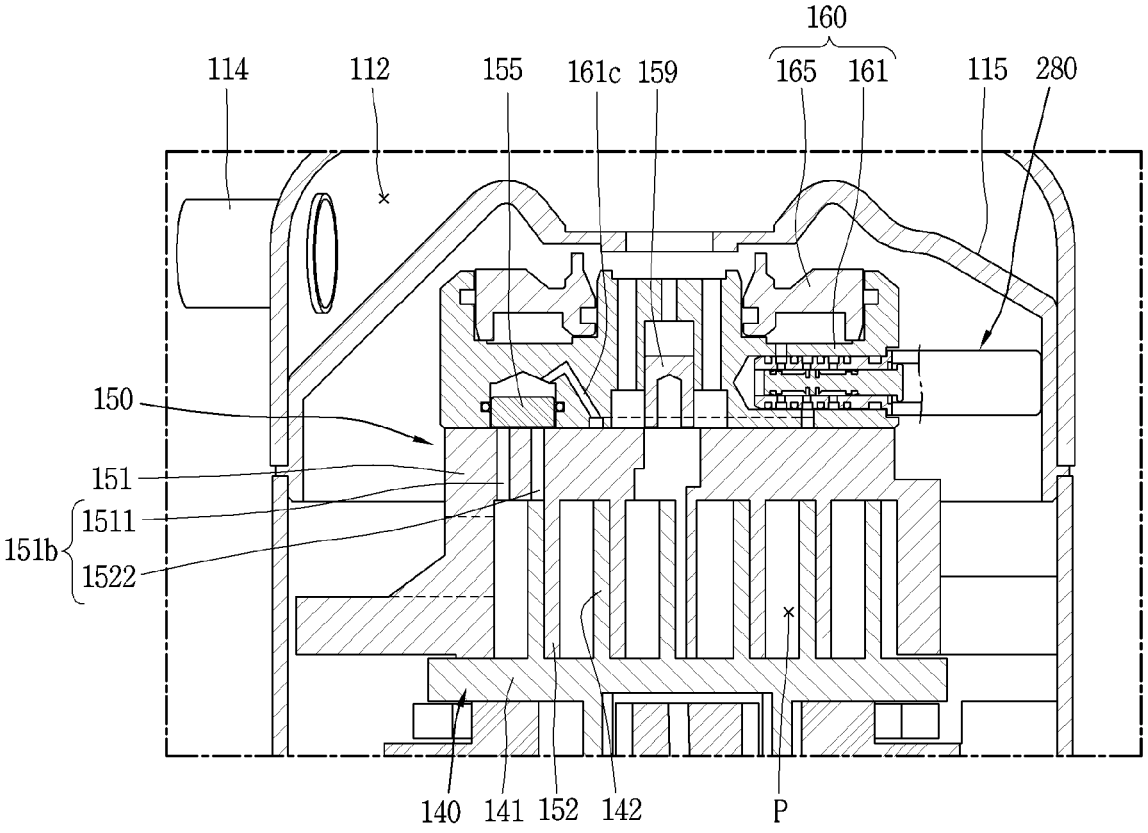
FIG. 11 is a cross-sectional view illustrating another example of a capacity variable device according to an embodiment of the present disclosure.
Figure 12:
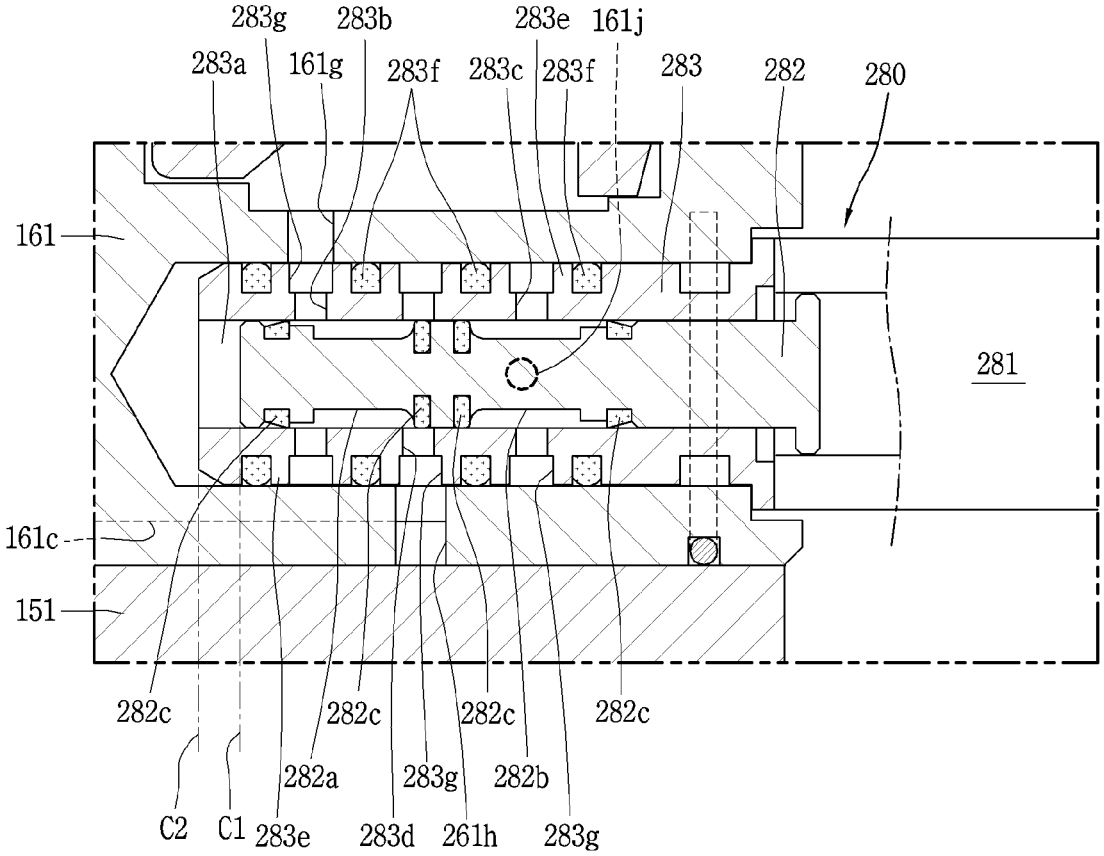
FIG. 12 is an enlarged cross-sectional view illustrating a first valve assembly in the capacity varying device according to the embodiment shown in FIG. 11.
Figure 13A:
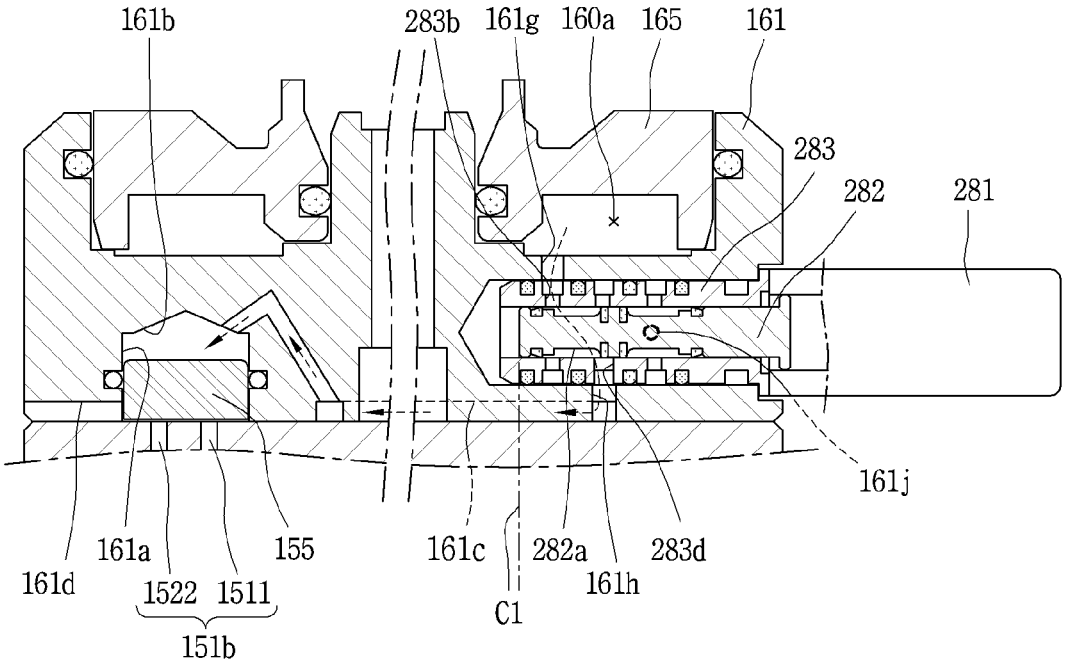
FIG. 13A is a schematic view illustrating the operation of a first valve assembly and a second valve assembly according to the operation mode of the compressor in FIG. 11, when in a power mode.
Figure 13B:
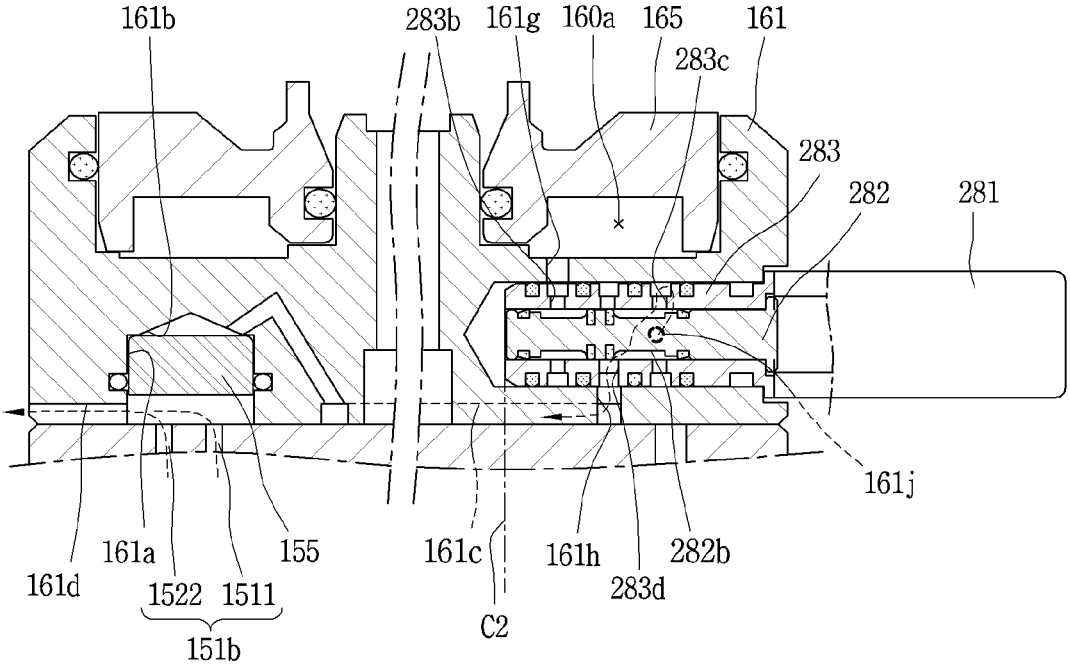
FIG. 13B is a schematic view illustrating the operation of a first valve assembly and a second valve assembly according to the operation mode of the compressor in FIG. 11, when in a power saving operation.

FIG. 11 is a cross-sectional view illustrating another example of a capacity variable device according to an embodiment of the present disclosure. FIG. 12 is an enlarged cross-sectional view illustrating a first valve assembly in the capacity varying device according to the embodiment shown in FIG. 11. FIGS. 13A and 13B are schematic views illustrating the operation of a first valve assembly and a second valve assembly according to the operation mode of the compressor shown in FIG. 11, wherein FIG. 13A is a power mode and FIG. 13B is a power saving operation.

As illustrated in the drawings, the basic configuration of a variable capacity device including a casing, a driving unit, a compression unit, and a bypass hole is similar to that of the above-described embodiment, and thus the detailed description thereof will be omitted. However, in this embodiment, since the control valve 280 is different from the above-described embodiment, the control valve will be described below.

The control valve 280 may be composed of a solenoid valve having a power supply unit 281 connected to external power to move a mover 281*b* between a first position and a second position depending on whether or not the external power is applied thereto. Therefore, hereinafter, the control valve is used interchangeably with a solenoid valve.

A power supply unit 281 may be provided with a mover (not shown) inside a coil (not shown) to which power is supplied, and a return spring (not shown) may be provided at one end of the mover. The other end of the mover may be coupled to a valve portion 282 for allowing a first connection hole 283*b* to communicate with a third connection hole 283*d* or allowing a second connection hole 283*c* to communicate with the third connection hole 283*d* in the passage guide portion 283 which will be described later.

Furthermore, the valve portion 282 may be formed in a circular rod shape (not limited thereto) and first and second connection grooves 282*a*, 282*b* may be formed on an outer circumferential surface of the valve portion 182, and O-rings 282*c* for sealing the first connection groove 282*a* and the second connection groove 282*b* may be inserted on both sides of the first connection groove 282*a*, on both sides of the second connection groove 282*b*, and between the first connection groove 282*a* and the second connection groove 282*b*. As a result, the first connection hole 283*b* and the third connection hole 283*d*, which will be described later, may be connected when the valve portion 282 is moved to the first position (C1), and the second connection hole 283*c* and the third connection hole 283*d*, which will be described later, can be connected when the valve portion 282 is moved to the second position (C2)

The passage guide portion 283 may be formed in a cylindrical shape (not limited thereto), and a valve space 283*a* into which the valve portion 282 is slidably inserted may be formed therein. A first connection hole 283*b* for communicating between the valve space 283*a* and the intermediate pressure hole 161*g* may be formed at one end portion of the passage guide portion 283, and a second connection hole 283*c* for communicating between the first connection hole 283*a* and the suction pressure hole 161*j* may be formed at the other end portion of the passage guide portion 283, and a third connection hole 283*d* communicating with the connection passage 161*h* of the back pressure passage 161*c* may be formed between the first connection hole 283*b* and the second connection hole 283*c*. As a result, the first connection hole 283*b*, the second connection hole 283*c*, and the third connection hole 283*d* may be formed to communicate with each other in the valve space 283*a*, and thus the connection hole 283*d* may be selectively communicated with the first connection hole 283*b* or the second connection hole 283*c* by the valve portion 282.

Sealing protrusion portions 283*e* may be formed at a predetermined height at an outside of the first connection hole 283*b* and an outside of the second connection hole 283*c*, between the first connection hole 283*b* and the third connection hole 283*d*, and between the second connection hole 283*c* and the third connection hole 283*d*, respectively, and O-rings 283*f* are respectively provided at each of the sealing protrusions 283*e*. As a result, a space 283*g* may be formed between an inner circumferential surface of the valve groove 161*i* and a periphery of the inlets of the first connection hole 283*b*, the second connection hole 283*c*, and the third connection hole 283*d*, respectively. Accordingly, only one of the first connection hole 283*b*, the second connection hole 283*c*, and the third connection hole 283*d* may be formed, but a plurality of connection holes may also be formed using the space 283*g* formed around the inlet of each of the foregoing connection holes.

The process of varying the capacity of the compressor in a scroll compressor according to an embodiment of the present disclosure will be operated as follows.

First, when the compressor is operated in a power mode as illustrated in FIGS. 12 and 13A, power is applied to the control valve 280, which is the second valve assembly, and the valve 282 may move to the first position (C1).

Then, the first connection hole 283*b* and the third connection hole 283*d* of the passage guide portion 283 may be connected by the first connection groove 282*a* of the valve portion 282, and thus the intermediate pressure hole 161*g* and the connection passage 161*h* are connected to each other.

Then, the intermediate pressure refrigerant may flow into the both differential pressure spaces 161*b* through the back pressure passage 161*c*.

Then, a pressure of the differential pressure space 161*b* pressurizes the back pressure surface of the second bypass valve 155 while forming an intermediate pressure greater than a pressure of the intermediate pressure chamber communicated with the bypass hole. At this time, since a transverse cross-sectional area of the differential pressure space 161*b* is larger than that of the bypass hole 151*b*, both the bypass valves 155 may be pressed against the pressure of the differential pressure space 161*b* so as to block the respective bypass holes 151*b*. As a result, refrigerant in the compression chamber does not leak to both the bypass holes 151*b*, and thus the compressor may continue a power operation.

On the other hand, when the compressor performs a power saving operation as illustrated in FIGS. 12 and 13B, power is turned off at the control valve 280, which is a second valve assembly, and then the valve portion 282 may return to the second position (C2) by the return spring (not shown).

Then, the second connection hole 283*c* and the third connection hole 283*d* of the passage guide portion 283 may be connected by the second connection groove 282*b* of the valve portion 282, and thus the suction pressure hole 161*j* and the connection passage 161*h* are connected to each other.

Then, the intermediate pressure refrigerant may flow into the both differential pressure spaces 161*b* through the back pressure passage 161*c*.

Then, a pressure of the differential pressure space 161*b* pressurizes the back pressure surface of the bypass valve 155 while forming a suction pressure. At this time, since a pressure of the intermediate pressure chamber is formed to be greater than that of the differential pressure space 161*b*, both the bypass valves 155 are respectively pressed and raised by the pressure of the intermediate pressure chamber.

Then, as refrigerant flows into the suction space 111 of the casing 110 through the respective exhaust grooves 161*d* in the respective intermediate pressure chambers while opening both the bypass holes 151*b*, the compressor performs a power saving operation.

In a scroll compressor according to the presently described embodiment, the second valve assembly corresponding to the control valve is provided at an inside of the casing, and the configuration and the resultant operation of the second valve assembly are different from those of the foregoing embodiment, but the position of the bypass holes and the configuration and operational effects of the first valve assembly for opening and closing the bypass hole are substantially the same as those of the foregoing embodiment. Accordingly, the detailed description thereof is not necessary.

On the other hand, in the above embodiments, a range of each compression chamber constituting the inner and outer pockets is 360° based on the crank angle, but according to circumstances, the range of each compression chamber may be larger or smaller than 360°. Even in this case, the first bypass hole and the second bypass hole may be respectively formed in neighboring or different compression chambers formed along the movement trajectory or path of the compression chamber. The detailed configuration and operation effects thereof are substantially the same as those of the foregoing embodiments, and the detailed description thereof is unnecessary.

On the other hand, according to the foregoing embodiments, a low pressure scroll compressor has been taken as an example, but the present disclosure may be similarly applied to all hermetic compressors in which an internal space of the casing is divided into a suction space which is a low pressure portion and a high pressure discharge space which is a high pressure portion.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing having an inner space;

a first scroll provided inside the casing, the first scroll being an orbiting scroll;

a second scroll provided inside the casing, the second scroll being a non-orbiting scroll;

a back pressure chamber assembly provided at a rear surface of the second scroll to form a back pressure chamber that is configured to pressurize the second scroll toward the first scroll;

a compression unit provided in the inner space of the casing to form a compression chamber that is composed of an inner pocket and an outer pocket that are formed by the first and second scrolls;

a plurality bypass holes provided in the compression unit to vary compression capacity of the scroll compressor, the plurality bypass holes comprise an inner first bypass hole and an inner second bypass hole formed in the inner pocket of the compression chamber and an outer first bypass hole and an outer second bypass hole formed in the outer pocket of the compression chamber, the inner first bypass hole and the inner second bypass hole are spaced apart from each other along a movement path of the inner pocket, and wherein the outer first bypass hole and the outer second bypass hole are spaced apart from each other along a movement path of the outer pocket;

a first valve assembly provided in the back pressure chamber assembly, and having a fist bypass valve that opens and closes the inner first bypass hole and the outer second bypass hole together, and a second bypass valve that opens and closes the inner second bypass hole and the outer first bypass hole together, and a second valve assembly provided outside the casing and selectively opening and closing the first inner and outer bypass holes and the second inner and outer bypass holes using the first valve assembly according to an operation mode, wherein the second valve assembly is coupled to a connection portion coupled through the casing so as to transfer refrigerant in the back pressure chamber into the first valve assembly or transfer the refrigerant in the first valve assembly into the inner space of the casing, wherein the connection portion comprising:

a first connection pipe having one end connected to a first inlet and outlet of the second valve assembly and the other end passing through the casing to communicate with the back pressure chamber;

a second connection pipe having one end connected to a second inlet and outlet of the second valve assembly and the other end penetrating through the casing to communicate with the inner space of the casing; and a third connection pipe having one end connected to a third inlet and outlet of the second valve assembly and the other end penetrating through the casing to communicate with the first valve assembly.

2. The scroll compressor of claim 1, wherein the first scroll comprises a first wrap and the second scroll comprises a second wrap, wherein the inner and outer first bypass holes are respectively formed in a radial direction on inner and outer sides of the second wrap, and the inner and outer second bypass holes are respectively formed in the radial direction on the inner and outer sides of the second wrap.

3. The scroll compressor of claim 2, wherein when a crank angle at which compression in the compression chamber is started is 0 degrees, the plurality bypass holes are formed in a compression chamber located at a side of the crank angle less than 360 degrees and a compression chamber located at a side of the crank angle greater than 360 degrees, respectively, with respect to a point at which the crank angle is 360 degrees in each of the pockets.

4. The scroll compressor of claim 1, wherein the bypass valve comprises a first bypass valve that opens and closes the first inner and outer bypass hole and a second bypass valve that opens and closes the second inner and outer bypass hole, wherein the back pressure chamber assembly is provided with a first valve space into which the first bypass valve is inserted so as to be axially movable and a second valve space into which the second bypass valve is inserted so as to be axially movable, wherein the back pressure chamber assembly further comprising:

a first differential pressure space formed on a rear side of the first bypass valve, and a second differential pressure space is formed on a rear side of the second bypass valve, a connection passage groove connecting the first differential pressure space and the second differential pressure space, a differential pressure hole formed through an outer circumferential surface of the back pressure chamber assembly in the middle of the connection passage groove to communicate with the third connection pipe of the connection portion, and an intermediate pressure hole formed in the back pressure chamber to penetrate through the outer circumferential surface of the back pressure chamber assembly and communicating with the first connection pipe of the connection portion.

* * * * *